US010757516B2

(12) United States Patent
Bergs et al.

(10) Patent No.: US 10,757,516 B2
(45) Date of Patent: Aug. 25, 2020

(54) ELECTROMAGNETIC TRANSDUCER WITH SPECIFIC INTERFACE GEOMETRIES

(71) Applicant: Cochlear Limited, Macquarie University, NSW (AU)

(72) Inventors: Tommy Bergs, Molnlycke (SE); Anders Kallsvik, Gothenburg (SE)

(73) Assignee: Cochlear Limited, Macquarie University, NSW (AU)

( * ) Notice: Subject to any disclaimer, the term of this patent is extended or adjusted under 35 U.S.C. 154(b) by 199 days.

(21) Appl. No.: 14/066,228

(22) Filed: Oct. 29, 2013

(65) Prior Publication Data

US 2015/0117689 A1 Apr. 30, 2015

(51) Int. Cl.
*H04R 25/00* (2006.01)

(52) U.S. Cl.
CPC ..... *H04R 25/606* (2013.01); *H04R 2460/13* (2013.01)

(58) Field of Classification Search
CPC .. H04R 2460/13; H04R 25/65; H04R 25/606; H04R 11/02; H04R 1/028; H04R 9/025; B60R 11/0217; F16L 23/04
See application file for complete search history.

(56) References Cited

U.S. PATENT DOCUMENTS 2,842,180 A * 7/1958 Brown ..... F16B 39/30 411/285
4,581,491 A 4/1986 Boothroyd
5,133,428 A * 7/1992 Perrson ..... B60R 11/0217 181/153
5,735,790 A * 4/1998 Håkansson ..... H04R 25/606 600/25
5,935,170 A * 8/1999 Håkansson ..... H04R 25/606 24/DIG. 53
7,021,676 B2 * 4/2006 Westerkull ..... F16L 23/04 285/307
8,139,800 B2 3/2012 Ho et al.
8,406,443 B2 3/2013 Westerkull et al.
2004/0210103 A1 10/2004 Westerkull
2005/0248158 A1 * 11/2005 Westerkull ..... F16L 23/04 285/411
2006/0042866 A1 3/2006 Widmer et al.
(Continued)

FOREIGN PATENT DOCUMENTS

JP 2010075394 A 4/2010
WO 02/09622 A1 2/2002

OTHER PUBLICATIONS

Hakansson et al., A noval bone conduction implant (BCI): Engineering aspects and pre-clinical studies, Jan. 23, 2010, vol. 9, pp. 203-215.*

(Continued)

*Primary Examiner* — Fan S Tsang
*Assistant Examiner* — Angelica M McKinney
(74) *Attorney, Agent, or Firm* — Pilloff Passino & Cosenza LLP; Martin J. Cosenza

(57) ABSTRACT

A device including a transducer and a connection assembly in fixed relationship with the transducer, configured to transfer vibrational energy directly or indirectly, at least one of to or from, the transducer, wherein a first component of the connection assembly is actively held by positive retention to the device by a second component of the connection assembly.

37 Claims, 16 Drawing Sheets

(56) References Cited

U.S. PATENT DOCUMENTS

2006/0050913 A1* 3/2006 Westerkull ..... H04R 25/606 381/326
2009/0024183 A1 1/2009 Fitchmun
2009/0082817 A1 3/2009 Jinton et al.
2009/0295202 A1* 12/2009 Takada ..... H04R 1/028 297/217.4
2010/0286776 A1 11/2010 Andersson
2010/0292529 A1 11/2010 Westerkull et al.
2011/0268303 A1* 11/2011 Ahsani ..... H04R 11/02 381/326
2012/0078035 A1* 3/2012 Andersson ..... H04R 25/606 600/25
2012/0088956 A1* 4/2012 Asnes ..... H04R 25/606 600/25
2012/0172658 A1 7/2012 Björn et al.
2012/0237067 A1* 9/2012 Asnes ..... H04R 9/025 381/326
2012/0302823 A1* 11/2012 Andersson ..... H04R 25/606 600/25
2013/0090518 A1* 4/2013 Bjorn et al. ..... 600/25
2014/0179985 A1* 6/2014 Andersson ..... H04R 25/606 600/25

OTHER PUBLICATIONS

Wiseman et al., Utilization of Plastic "Washer" to Prevent Auricular Prosthesis Abutment Overgrowth: Report of a Case and Description of a Technique, 2001, Int J Oral Maxillofac Implants, vol. 16, pp. 880-882.*

Tjellstrom et al., Cochlear Baha 3 Surgery Guide a Bone Conduction Hearing Solution, Sep. 2010, Cochlear Americas, pp. 1- 40.*

Cosenza, Martin, "Believed 102 Art", believed to be known or used by others in the U.S. before Oct., 2013.

* cited by examiner

ELECTROMAGNETIC TRANSDUCER WITH SPECIFIC INTERFACE GEOMETRIES

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or the ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, which rely primarily on the principles of air conduction, certain types of hearing prostheses commonly referred to as bone conduction devices, convert a received sound into vibrations. The vibrations are transferred through the skull to the cochlea causing generation of nerve impulses, which result in the perception of the received sound. Bone conduction devices are suitable to treat a variety of types of hearing loss and may be suitable for individuals who cannot derive sufficient benefit from acoustic hearing aids, cochlear implants, etc, or for individuals who suffer from stuttering problems.

SUMMARY

In accordance with one aspect, there is a device, comprising a transducer, and a connection assembly in fixed relationship with the transducer, configured to transfer vibrational energy directly or indirectly, at least one of to or from, the transducer, wherein a first component of the connection assembly is actively held by positive retention to the device by a second component of the connection assembly.

In accordance with another aspect, there is a device, comprising a transducer, and a housing encompassing at least a portion of the transducer, wherein the device includes a rotation limiter that limits rotation of the housing relative to the transducer.

In accordance with another aspect, there is a device, comprising a removable component of a bone conduction device, including a connector apparatus configured to removably connect the removable component to a recipient skin penetrating component, wherein the removable component of the bone conduction device does not include any metallic components within at least about 3 mm from a longitudinal end of the removable component on the connector side thereof.

In accordance with another embodiment, there is a device, comprising a removable component of a bone conduction device, including a connector configured to removably connect the removable component to a metallic skin penetrating component, wherein the removable component is configured such that when the connector is operationally coupled to the metallic skin penetrating component when the connector is grounded and a potential difference between the connector and the skin penetrating component 0.1 seconds prior to the connector contacting the skin penetrating component is 10,000 volts, this potential difference is substantially maintained, in the absence of any change in the grounding state of the metallic skin penetrating component, for at least 0.1 seconds after the connector is operationally coupled to the skin penetrating component.

In accordance with another aspect, there is a device, comprising a removable component of a bone conduction device, including a connector configured to removably connect the removable component to a metallic skin penetrating component, wherein the removable component is configured such that when the connector is operationally coupled to the metallic skin penetrating component when one of the skin penetrating component and the connector is grounded and the other of the skin penetrating component and the connector has a charged capacitance of 100 picofarads, and a potential difference between the connector and the skin penetrating component is 10,000 volts, a total energy flow to the grounded component is no more than 50 millijoules per second.

In accordance with another aspect, there is a device as detailed above an/or below, wherein the removable component is configured such that when the connector is operationally coupled to the metallic skin penetrating component when one of the skin penetrating component and the connector is grounded and the other of the skin penetrating component and the connector has a charged capacitance of 100 picofarads, and a potential difference between the connector and the skin penetrating component is 10,000 volts, a total energy flow to the grounded component is no more than 50 millijoules per microsecond.

In accordance with another aspect, there is a device as detailed above an/or below, wherein the removable component is configured such that when the connector is operationally coupled to the metallic skin penetrating component when one of the skin penetrating component and the connector is grounded and the other of the skin penetrating component and the connector has a charged capacitance of 100 picofarads, and a potential difference between the connector and the skin penetrating component is 10,000 volts, a total energy flow to the grounded component is no more than 50 millijoules per millisecond.

In accordance with another aspect, there is a device as detailed above and/or below, wherein the removable component is configured such that when the connector is operationally coupled to the metallic skin penetrating component when the connector is grounded and a potential difference between the connector and the skin penetrating component 0.1 seconds prior to the connector contacting the skin penetrating component is 10,000 volts, this potential difference will be substantially maintained, in the absence of any change in the grounding state of the metallic skin penetrating component, for at least 1.0 seconds after the connector is operationally coupled to the skin penetrating component.

BRIEF DESCRIPTION OF THE DRAWINGS

Some embodiments are described below with reference to the attached drawings, in which.

DETAILED DESCRIPTION

Figure 1A:
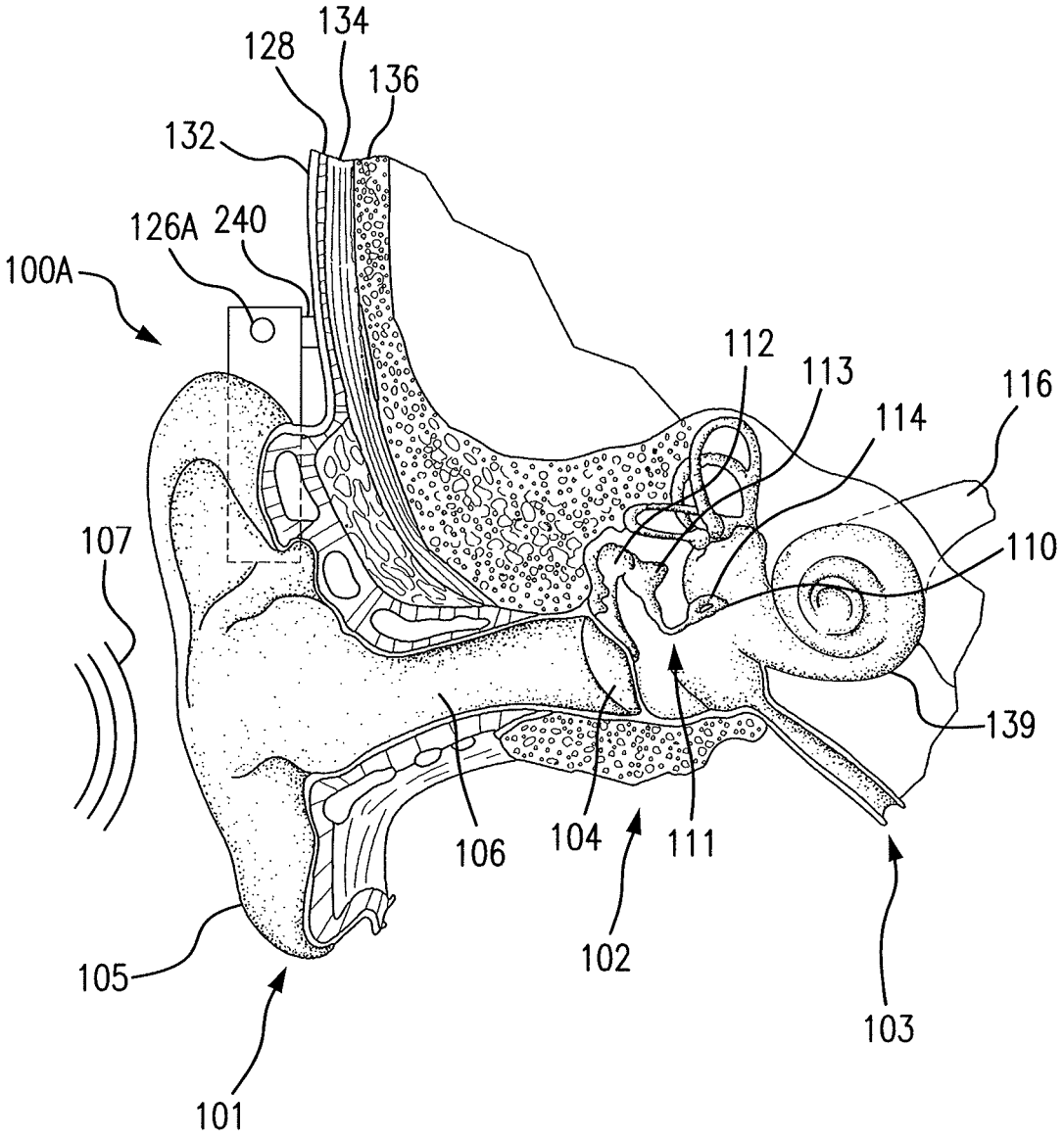
FIG. 1A is a perspective view of an exemplary bone conduction device in which at least some embodiments can be implemented.

FIG. 1A is a perspective view of a bone conduction device 100A in which embodiments may be implemented. As shown, the recipient has an outer ear 101, a middle ear 102 and an inner ear 103. Elements of outer ear 101, middle ear 102 and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra *ovalis* 210 through three bones of middle ear 102, collectively referred to as the ossicles 111 and comprising the malleus 112, the incus 113 and the stapes 114. The ossicles 111 of middle ear 102 serve to filter and amplify acoustic wave 107, causing oval window 210 to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1A also illustrates the positioning of bone conduction device 100A relative to outer ear 101, middle ear 102 and inner ear 103 of a recipient of device 100. As shown, bone conduction device 100 is positioned behind outer ear 101 of the recipient and comprises a sound input element 126A to receive sound signals. Sound input element may comprise, for example, a microphone, telecoil, etc. In an exemplary embodiment, sound input element 126A may be located, for example, on or in bone conduction device 100A, or on a cable extending from bone conduction device 100A.

In an exemplary embodiment, bone conduction device 100A comprises an operationally removable component and a bone conduction implant. The operationally removable component is operationally releasably coupled to the bone conduction implant. By operationally releasably coupled, it is meant that it is releasable in such a manner that the recipient can relatively easily attach and remove the operationally removable component during normal use of the bone conduction device 100A. Such releasable coupling is accomplished via a coupling assembly of the operationally removable component and a corresponding mating apparatus of the bone conduction implant, as will be detailed below. This as contrasted with how the bone conduction implant is attached to the skull, as will also be detailed below. The operationally removable component includes a sound processor (not shown), a vibrating electromagnetic actuator and/or a vibrating piezoelectric actuator and/or other type of actuator (not shown—which are sometimes referred to herein as a species of the genus vibrator) and/or various other operational components, such as sound input device 126A. In this regard, the operationally removable component is sometimes referred to herein as a vibrator unit. More particularly, sound input device 126A (e.g., a microphone) converts received sound signals into electrical signals. These electrical signals are processed by the sound processor. The sound processor generates control signals which cause the actuator to vibrate. In other words, the actuator converts the electrical signals into mechanical motion to impart vibrations to the recipient's skull.

As illustrated, the operationally removable component of the bone conduction device 100A further includes a coupling assembly 240 configured to operationally removably attach the operationally removable component to a bone conduction implant (also referred to as an anchor system and/or a fixation system) which is implanted in the recipient. In the embodiment of FIG. 1, coupling assembly 240 is coupled to the bone conduction implant (not shown) implanted in the recipient in a manner that is further detailed below with respect to exemplary embodiments of the bone conduction implant. Briefly, an exemplary bone conduction implant may include a percutaneous abutment attached to a bone fixture via a screw, the bone fixture being fixed to the recipient's skull bone 136. The abutment extends from the bone fixture which is screwed into bone 136, through muscle 134, fat 128 and skin 232 so that the coupling assembly may be attached thereto. Such a percutaneous abutment provides an attachment location for the coupling assembly that facilitates efficient transmission of mechanical force.

It is noted that while many of the details of the embodiments presented herein are described with respect to a percutaneous bone conduction device, some or all of the teachings disclosed herein may be utilized in transcutaneous bone conduction devices and/or other devices that utilize a vibrating electromagnetic actuator. For example, embodiments include active transcutaneous bone conduction systems utilizing the electromagnetic actuators disclosed herein and variations thereof where at least one active component (e.g. the electromagnetic actuator) is implanted beneath the skin. Embodiments also include passive transcutaneous bone conduction systems utilizing the electromagnetic actuators disclosed herein and variations thereof where no active component (e.g., the electromagnetic actuator) is implanted beneath the skin (it is instead located in an external device), and the implantable part is, for instance a magnetic pressure plate. Some embodiments of the passive transcutaneous bone conduction systems are configured for use where the vibrator (located in an external device) containing the electromagnetic actuator is held in place by pressing the vibrator against the skin of the recipient. In an exemplary embodiment, an implantable holding assembly is implanted in the recipient that is configured to press the bone conduction device against the skin of the recipient. In other embodiments, the vibrator is held against the skin via a magnetic coupling (magnetic material and/or magnets being implanted in the recipient and the vibrator having a magnet and/or magnetic material to complete the magnetic circuit, thereby coupling the vibrator to the recipient).

Figure 1B:
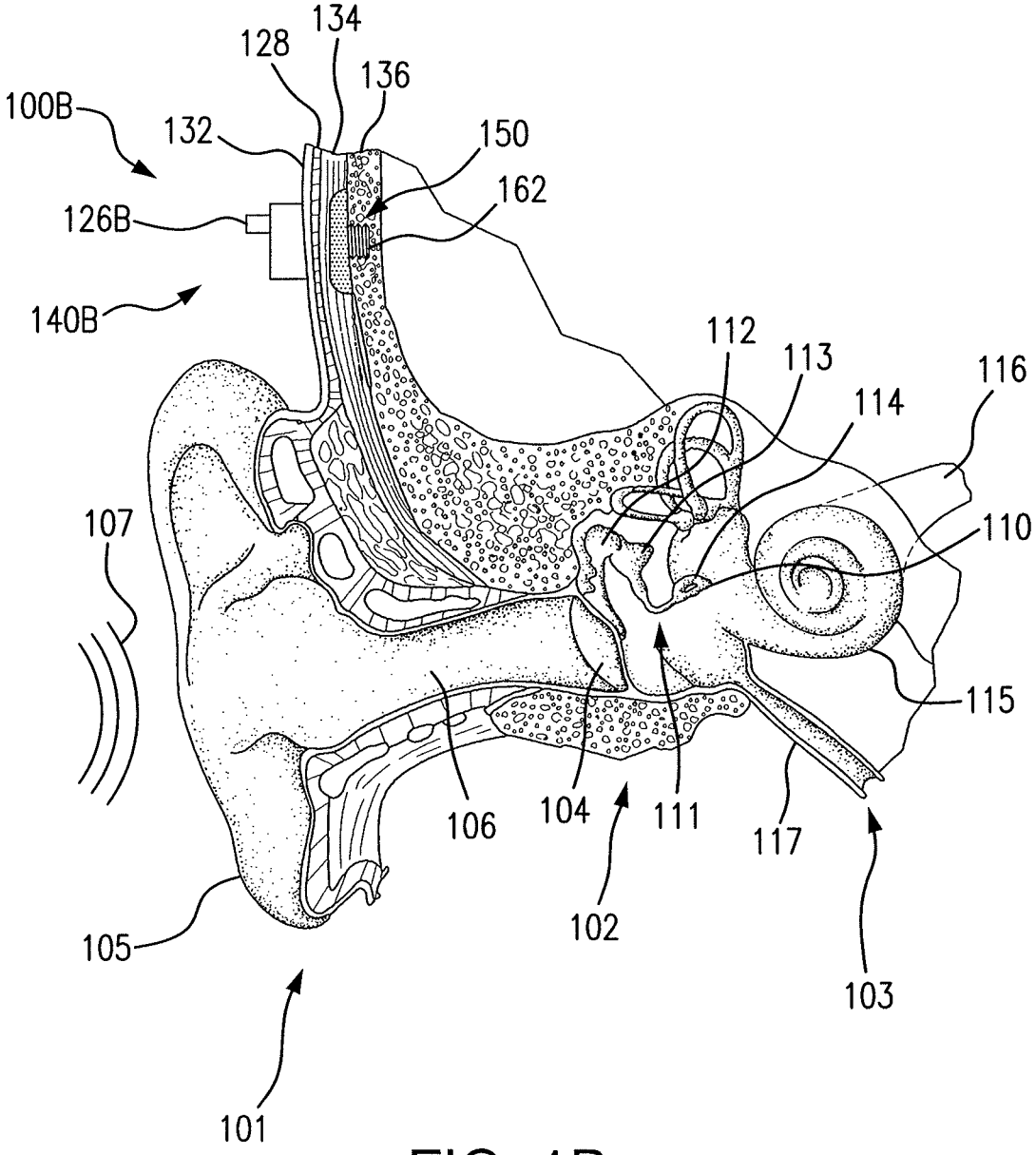
FIG. 1B is a perspective view of an alternate exemplary bone conduction device in which at least some embodiments can be implemented.

More specifically, FIG. 1B is a perspective view of a transcutaneous bone conduction device 100B in which embodiments can be implemented.

FIG. 1A also illustrates the positioning of bone conduction device 100B relative to outer ear 101, middle ear 102 and inner ear 103 of a recipient of device 100. As shown, bone conduction device 100B is positioned behind outer ear 101 of the recipient. Bone conduction device 100B comprises an external component 140B (corresponding to an operationally removable component) and implantable component 150. The bone conduction device 100B includes a sound input element 126B to receive sound signals. As with sound input element 126A, sound input element 126B may comprise, for example, a microphone, telecoil, etc. In an exemplary embodiment, sound input element 126B may be located, for example, on or in bone conduction device 100B, on a cable or tube extending from bone conduction device 100B, etc. Alternatively, sound input element 126B may be subcutaneously implanted in the recipient, or positioned in the recipient's ear. Sound input element 126B may also be a component that receives an electronic signal indicative of sound, such as, for example, from an external audio device. For example, sound input element 126B may receive a sound signal in the form of an electrical signal from an MP3 player electronically connected to sound input element 126B.

Bone conduction device 100B comprises a sound processor (not shown), an actuator (also not shown) and/or various other operational components. In operation, sound input device 126B converts received sounds into electrical signals. These electrical signals are utilized by the sound processor to generate control signals that cause the actuator to vibrate. In other words, the actuator converts the electrical signals into mechanical vibrations for delivery to the recipient's skull.

In accordance with some embodiments, a fixation system 162 may be used to secure implantable component 150 to skull 136. As described below, fixation system 162 may be a bone screw fixed to skull 136, and also attached to implantable component 150.

In one arrangement of FIG. 1B, bone conduction device 100B can be a passive transcutaneous bone conduction device. That is, no active components, such as the actuator, are implanted beneath the recipient's skin 132. In such an arrangement, the active actuator is located in external component 140B, and implantable component 150 includes a magnetic plate, as will be discussed in greater detail below. The magnetic plate of the implantable component 150 vibrates in response to vibration transmitted through the skin, mechanically and/or via a magnetic field, that are generated by an external magnetic plate.

In another arrangement of FIG. 1B, bone conduction device 100B can be an active transcutaneous bone conduction device where at least one active component, such as the actuator, is implanted beneath the recipient's skin 132 and is thus part of the implantable component 150. As described below, in such an arrangement, external component 140B may comprise a sound processor and transmitter, while implantable component 150 may comprise a signal receiver and/or various other electronic circuits/devices.

Figure 2:
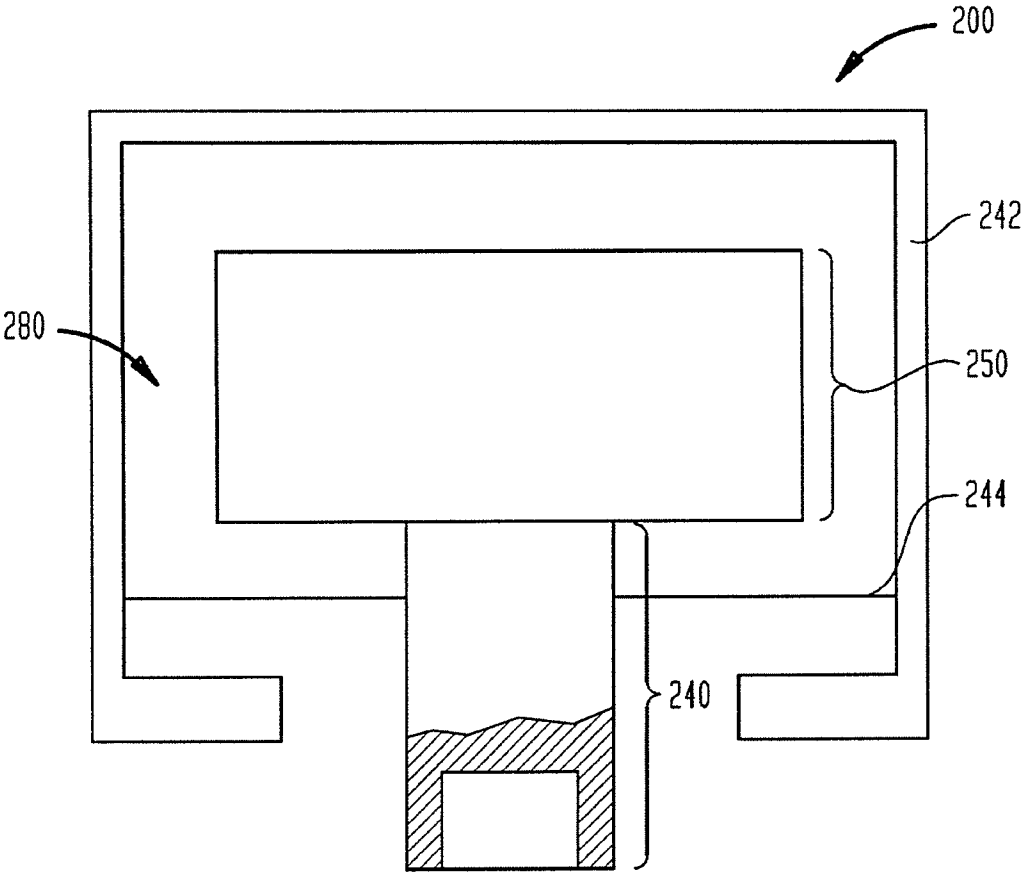
FIG. 2 is a schematic diagram conceptually illustrating a removable component of a percutaneous bone conduction device in accordance with at least some exemplary embodiments.

FIG. 2 is an embodiment of an operationally removable component of a bone conduction device 200 in accordance with an embodiment corresponding to that of FIG. 1A, illustrating use of a percutaneous bone conduction device. Removable component of bone conduction device 200, corresponding to, for example, the removable component of element 100A of FIG. 1A, and includes a housing 242, a vibrating electromagnetic actuator 250, a coupling assembly 240 that extends from housing 242 and is mechanically linked to vibrating electromagnetic actuator 250. Collectively, vibrating electromagnetic actuator 250 and coupling assembly 240 form a vibrating electromagnetic actuator-coupling assembly 280. Vibrating electromagnetic actuator-coupling assembly 280 is suspended in housing 242 by spring 244. In an exemplary embodiment, spring 244 is connected to coupling assembly 240, and vibrating electromagnetic actuator 250 is supported by coupling assembly 240. It is noted that while embodiments are detailed herein that utilize a spring, alternate embodiments can utilize other types of resilient elements. Accordingly, unless otherwise noted, disclosure of a spring herein also includes disclosure of any other type of resilient element that can be utilized to practice the respective embodiment and/or variations thereof.

Figure 3:
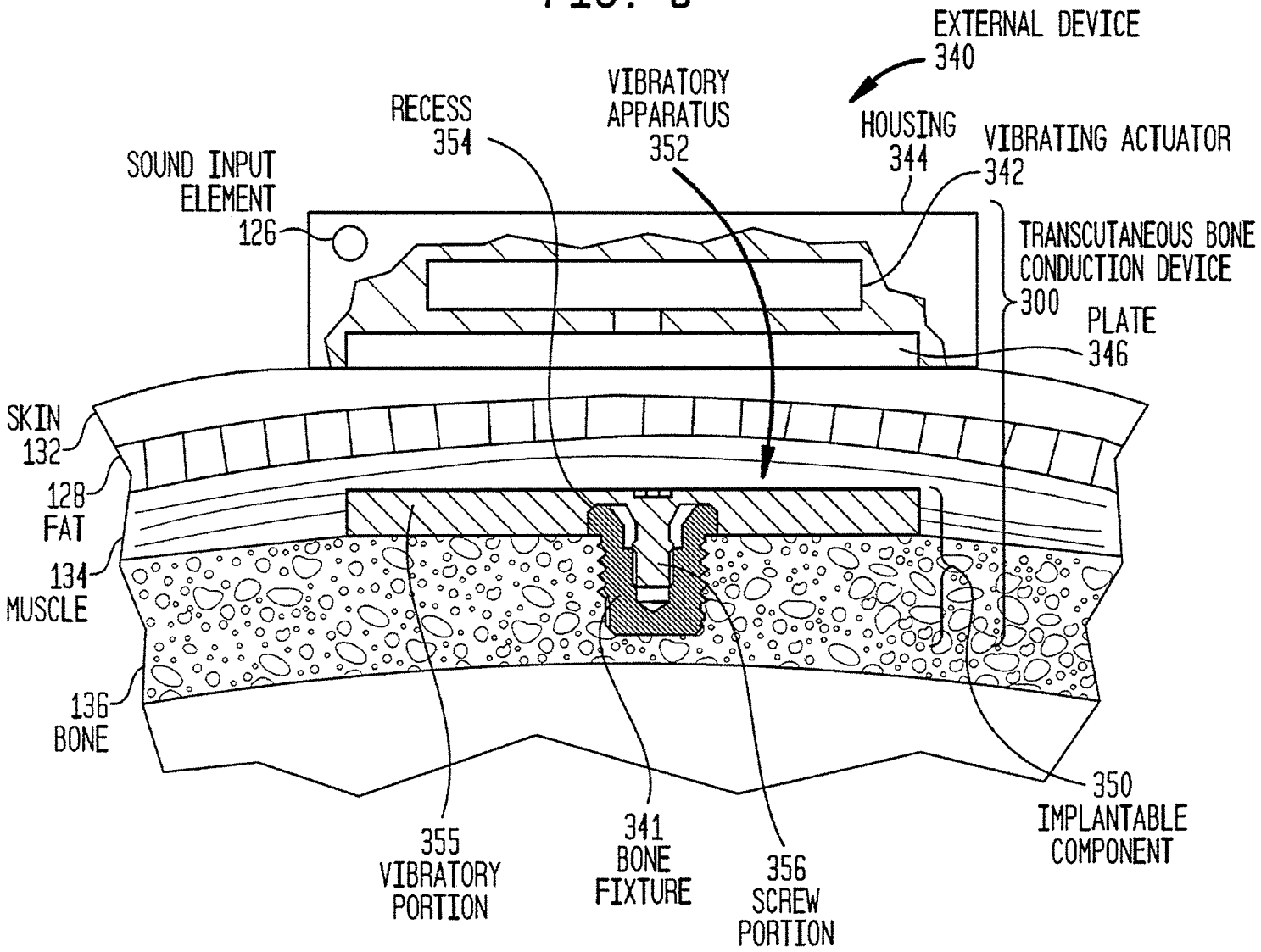
FIG. 3 is a schematic diagram conceptually illustrating a passive transcutaneous bone conduction device in accordance with at least some exemplary embodiments.

FIG. 3 depicts an exemplary embodiment of a transcutaneous bone conduction device 300 according to an embodiment that includes an external device 340 (corresponding to, for example, element 140B of FIG. 1B) and an implantable component 350 (corresponding to, for example, element 150 of FIG. 1B). The transcutaneous bone conduction device 300 of FIG. 3 is a passive transcutaneous bone conduction device in that a vibrating electromagnetic actuator 342 is located in the external device 340. Vibrating electromagnetic actuator 342 is located in housing 344 of the external component, and is coupled to plate 346. Plate 346 may be in the form of a permanent magnet and/or in another form that generates and/or is reactive to a magnetic field, or otherwise permits the establishment of magnetic attraction between the external device 340 and the implantable component 350 sufficient to hold the external device 340 against the skin of the recipient.

In an exemplary embodiment, the vibrating electromagnetic actuator 342 is a device that converts electrical signals into vibration. In operation, sound input element 126 converts sound into electrical signals. Specifically, the transcutaneous bone conduction device 300 provides these electrical signals to vibrating electromagnetic actuator 342, or to a sound processor (not shown) that processes the electrical signals, and then provides those processed signals to vibrating electromagnetic actuator 342. The vibrating electromagnetic actuator 342 converts the electrical signals (processed or unprocessed) into vibrations. Because vibrating electromagnetic actuator 342 is mechanically coupled to plate 346, the vibrations are transferred from the vibrating electromagnetic actuator 342 to plate 346. Implanted plate assembly 352 is part of the implantable component 350, and is made of a ferromagnetic material that may be in the form of a permanent magnet, that generates and/or is reactive to a magnetic field, or otherwise permits the establishment of a magnetic attraction between the external device 340 and the implantable component 350 sufficient to hold the external device 340 against the skin of the recipient. Accordingly, vibrations produced by the vibrating electromagnetic actuator 342 of the external device 340 are transferred from plate 346 across the skin to plate 355 of plate assembly 352. This can be accomplished as a result of mechanical conduction of the vibrations through the skin, resulting from the external device 340 being in direct contact with the skin and/or from the magnetic field between the two plates. These vibrations are transferred without penetrating the skin with a solid object such as an abutment as detailed herein with respect to a percutaneous bone conduction device.

As may be seen, the implanted plate assembly 352 is substantially rigidly attached to a bone fixture 341 in this embodiment. Plate screw 356 is used to secure plate assembly 352 to bone fixture 341. The portions of plate screw 356 that interface with the bone fixture 341 substantially correspond to an abutment screw discussed in some additional detail below, thus permitting plate screw 356 to readily fit into an existing bone fixture used in a percutaneous bone conduction device. In an exemplary embodiment, plate screw 356 is configured so that the same tools and procedures that are used to install and/or remove an abutment screw (described below) from bone fixture 341 can be used to install and/or remove plate screw 356 from the bone fixture 341 (and thus the plate assembly 352).

It is noted that with respect to the embodiments of FIGS. 2-3, each embodiment has a fixation component. With respect to FIG. 2, the fixation component is a recipient coupling in the form of coupling assembly 240. With respect to FIG. 3, the fixation component is a component (details not specifically shown) of the pressure plate 346.

As will be further detailed below, various teachings detailed herein and/or variations thereof can be applicable to the various embodiments of FIGS. 2-3 and/or variations thereof. In an exemplary embodiment, the various teachings detailed herein and/or variations thereof can be applied to the various embodiments of FIGS. 2-3 to obtain a hearing prosthesis where a vibrating electromagnetic actuator is in vibrational communication with a fixation component such that vibrations generated by the vibrating electromagnetic actuator in response to a sound captured by sound capture devices of the various embodiments are ultimately transmitted to bone of a recipient in a manner that at least effectively evokes hearing percept. By "effectively evokes a hearing percept," it is meant that the vibrations are such that a typical human between 18 years old and 40 years old having a fully functioning cochlea receiving such vibrations, where the vibrations communicate speech, would be able to understand the speech communicated by those vibrations in a manner sufficient to carry on a conversation provided that those adult humans are fluent in the language forming the basis of the speech. That said, it is noted that embodiments can also effectively evoke a hearing percept in humans younger than 18 years old and older than 40 years old and/or with humans without a fully functioning cochlea and/or in humans that are not completely fluent in the language forming the basis of the speech. In other words, the aforementioned population of 18 to 40 year olds is provided by way of example and not by way of limitation.

Some exemplary features of the vibrating electromagnetic actuator usable in some embodiments of the bone conduction devices detailed herein and/or variations thereof will now be described in terms of an operationally removable component of the bone conduction device used in the context of the percutaneous bone conduction device of FIG. 1A. It is noted that any and/or all of these features and/or variations thereof may be utilized in transcutaneous bone conduction devices and/or other types of prostheses and/or medical devices and/or other devices. It is further noted that while embodiments detailed herein are often referred to in terms of the electromagnetic transducer being an actuator, is to be understood that any of these teachings, unless otherwise specifically noted, are equally applicable to electromagnetic transducers that receive vibration and output a signal resulting from the received vibrations.

Figure 4A:
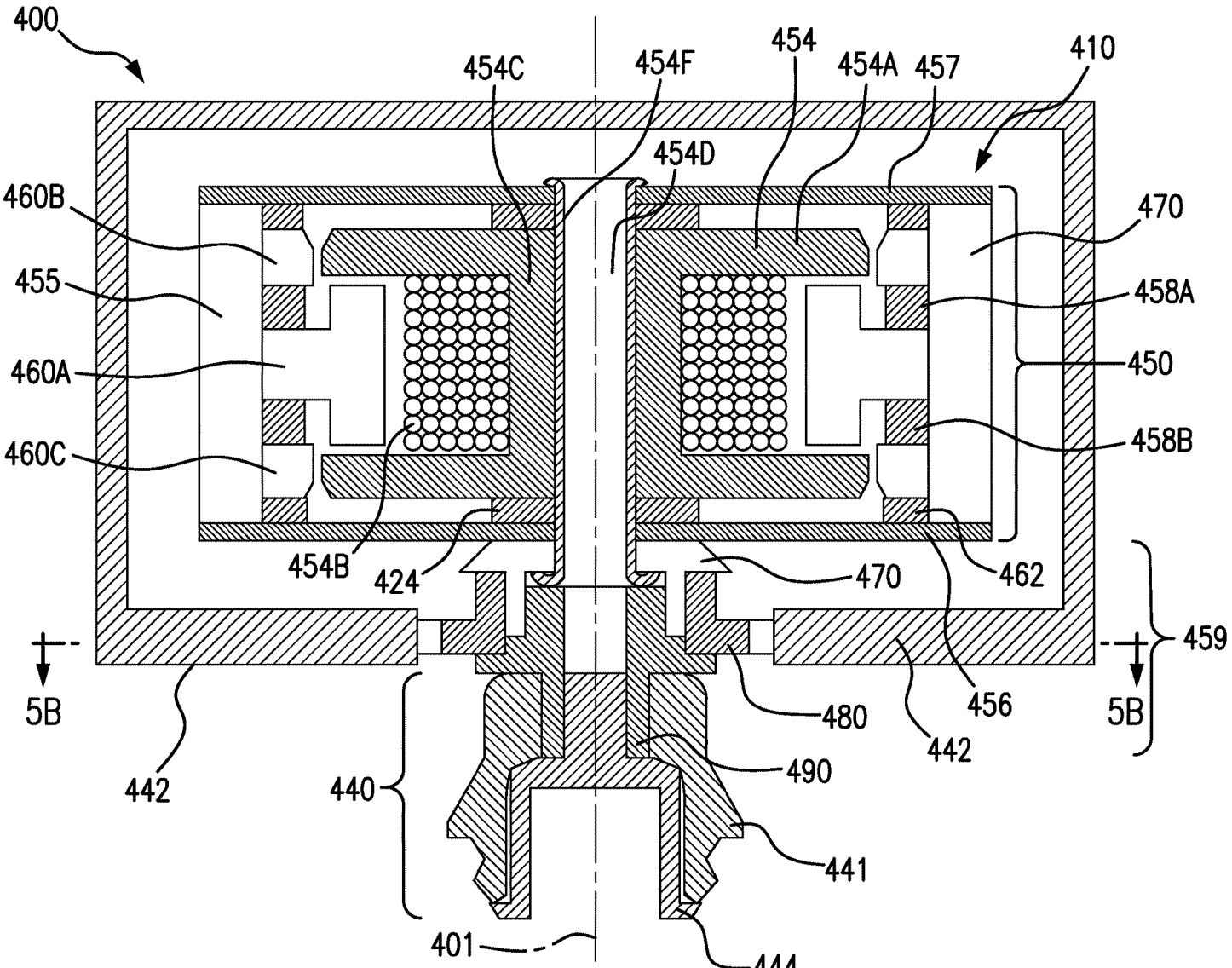
FIG. 4A is a cross-sectional view of an example of a removable component of the bone conduction device of FIG. 2.

FIG. 4A is a cross-sectional view of an operationally removable component of a bone conduction device 400 which can correspond to operationally removable component of bone conduction device 200 of FIG. 2. Removable component of bone conduction device 400 includes a vibrating electromagnetic actuator-coupling assembly 410, which can correspond to vibrating electromagnetic actuator-coupling assembly 280 detailed above. The vibrating electromagnetic actuator-coupling assembly 410 includes a vibrating electromagnetic transducer 450 in the form of an actuator, and a coupling assembly 440. Coupling assembly 440 includes a coupling 441, which is mounted on an extension assembly 459 (discussed in greater detail below), and sleeve 444 (a protective sleeve—utilitarian features of the sleeve 444 are described below). As can be seen from FIG. 4A, in this exemplary embodiment, the coupling assembly 440 is not a monolithic component. For example, sleeve 544 is a separate component from coupling 541.

Also shown in FIG. 4A, the removable component 400 includes a housing 442, which can correspond to housing 242 of FIG. 2. The spring (which can correspond to spring 244 of FIG. 2) supporting the vibrating electromagnetic actuator-coupling assembly 410 in the housing 442 is not shown for clarity, but would extend inside the housing 442 horizontally (with respect to the frame of reference of FIG. 4A) from the extension assembly 459 to the vertical housing wall. It is noted that while portions of extension assembly 459 are depicted in FIG. 4A as overlapping portions of housing 442, during rest, these components do not contact each other in at least some embodiments. The overlapping in FIG. 4A is a result of the fact that the components are shown in cross-sectional view in a single plane. Additional details of this feature of the embodiment of FIG. 4A are discussed below.

As illustrated in FIG. 4A, vibrating electromagnetic actuator 450 includes a bobbin assembly 454 and a counterweight assembly 455. As illustrated, bobbin assembly 454 includes a bobbin 454A and a coil 454B that is wrapped around a core 454C of bobbin 454A. The actuator 450 also includes a pipe rivet 454F that passes through the holes of the actuator 450 and fixes the extension assembly 459 to the electromagnetic transducer 450. As can be seen, the rivet 454F includes a head (upper part) and a flared portion (lower part) that secures the electromagnetic transducer 450 to the extension assembly 459. In this regard, these components correspond to the traditional components of a pipe rivet. In an exemplary embodiment, the rivet 454F is slip-fit or interference-fit into the space passing through bobbin, although other types of fit, such as a clearance-fit, can be utilized. Any type of fit that will enable the teachings detailed herein and/or the variations thereof to be practiced can be utilized in at least some embodiments. In an exemplary embodiment, the rivet is made of the same or similar material, at least from a magnetic permeability sense, as that of the bobbin body 454A.

In an exemplary embodiment, an embryonic rivet has one or both ends that is/are straight (not flared). During assembly, the rivet is fit through all of the pertinent holes of the electromagnetic transducer 450, and fit through the hole in the extension assembly 459 (at the top), and a flaring mandrel is used to flare the rivet to the configuration depicted in FIG. 4A, thus positively retaining at least the interfacing portion of the extension assembly 459 to the electromagnetic transducer 450. Other embodiments can utilize another type of configuration in place of the rivet 454F (e.g., a bolt and nut arrangement, etc.).

It is noted that unless otherwise specified, the electromagnetic transducers detailed herein are radially symmetrical.

Figure 4B:
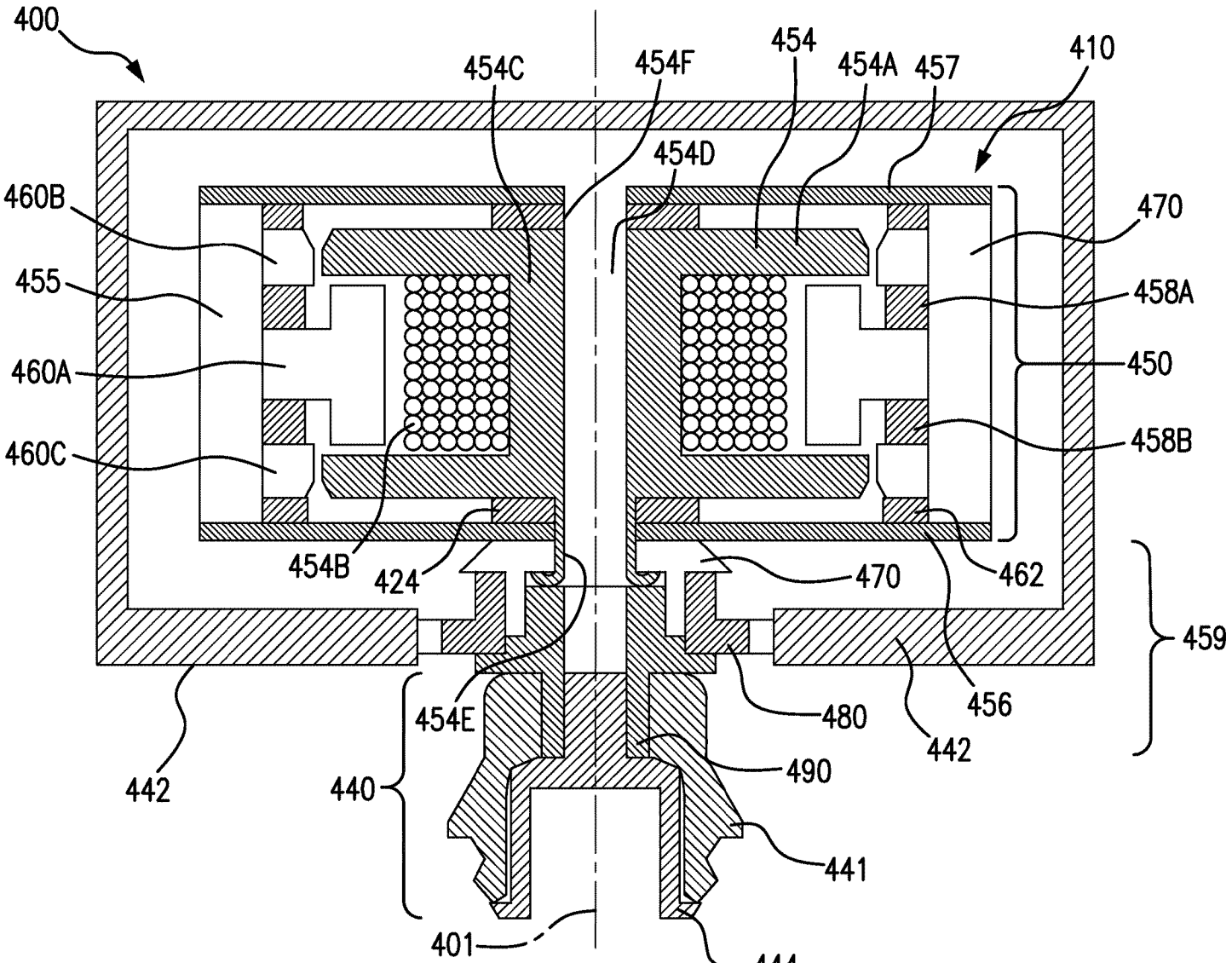
FIG. 4B is a cross-sectional view of another example of a removable component of the bone conduction device of FIG. 2.

FIG. 4B depicts an alternate embodiment of a removable component of a bone conduction device 400, which corresponds to the removable component 400 of FIG. 4A, with the exception that the holes though the bobbin 454, springs 456 and 457 and spacers 424 are smaller that of FIG. 4A, and the bobbin includes include extension 454E that extends through the spacer 424, instead of pipe rivet 454F. Bobbin extension 454E, which extends through the hole in spring 456 and interfaces with the extension assembly 559 (more on this below). In the exemplary embodiment, the distal end of the bobbin extension 454E includes a flared portion that secures the electromagnetic transducer 450 to the extension assembly 459. In an exemplary embodiment, the embryonic bobbin 554A has a bobbin extension 454E (also an embryonic component) that is straight (not flared). During assembly, the embryonic bobbin extension 454E is fit through the hole in the extension assembly 459 (at the top), and a flaring mandrel is used to flare the bobbin extension 454E to the configuration depicted in FIG. 4A, thus positively retaining at least the interfacing portion of the extension assembly 459 to the electromagnetic transducer 450.

Counterweight assembly 455 includes springs 456 and 457, permanent magnets 458A and 458B, yokes 460A, 460B and 460C, spacers 462, and counterweight mass 470. Spacers 462 provide a connective support between spring 456 and the other elements of counterweight assembly 455 just detailed, although it is noted that in some embodiments, these spacers are not present, and the spring is connected only to the counterweight mass 470, while in other embodiments, the spring is only connected to the spacers. Springs 456 and 457 connect bobbin assembly 454 via spacers 422 and 424 to the rest of counterweight assembly 455, and permit counterweight assembly 455 to move relative to bobbin assembly 554 upon interaction of a dynamic magnetic flux, produced by coil 454B. The static magnetic flux is produced by permanent magnets 458A and 458B of counterweight assembly 455. In this regard, counterweight assembly 455 is a static magnetic field generator, where the permanent magnets 458A and 458B are arranged such that their respective south poles face each other and their respective north poles face away from each other. It is noted that in other embodiments, the respective south poles may face away from each other and the respective north poles may face each other.

Coil 454B, in particular, may be energized with an alternating current to create the dynamic magnetic flux about coil 454B. In an exemplary embodiment, bobbin 454A is made of a soft iron. The iron of bobbin 454A is conducive to the establishment of a magnetic conduction path for the dynamic magnetic flux. In an exemplary embodiment, the yokes of the counterweight assembly 455 are made of soft iron also conducive to the establishment of a magnetic conduction path for the static magnetic flux.

It is noted that the electromagnetic actuator of FIG. 4A is a balanced actuator. In alternate configuration a balanced actuator can be achieved by adding additional axial air gaps above and below the outside of bobbin 454B (and in some variations thereof, the radial air gaps are not present due to the addition of the additional axial air gaps). In such an alternate configuration, the yokes 460B and 460C are reconfigured to extend up and over the outside of bobbin 454B (the geometry of the permanent magnets 458A and 458B and/or the yoke 460A might also be reconfigured to achieve utility of the actuator).

It is further noted that in alternative embodiments, the teachings detailed herein and/or variations thereof can be applicable to unbalanced electromagnetic actuators, at least with respect to a bobbin thereof through which a dynamic magnetic flux passes.

As can be seen from FIGS. 4A and 4B, the vibrating electromagnetic transducer 450 includes a passage passing all the way therethrough. (In order to better convey the concepts of the teachings herein, the "background lines" of the cross-sectional views are not always depicted in the figures. It is to be understood that in at least the case of a radially symmetric transducer according to the embodiment of FIGS. 4A and 4B, components such as springs 456 and 457, the bobbin 454, etc., extend about the longitudinal axis of the transducer. It was determined that depicting such background lines would distract from the concepts of the teachings herein.) More particularly, the bobbin 454A includes space therein, in the form of bore 454D that passes all the way therethough, including through bobbin extension 454E in the case of the embodiment of FIG. 4B. This space constitutes a passage through the bobbin 454A, which passage is in the from a space inside the transducer (inside the bobbin body 454A) to the sleeve 441. Also as can be seen, this space extends through extension assembly 459. Also, spacers 462 and 424 and springs 456 and 457 have a space in the form of a bore that passes all the way therethrough. These spaces constitute a passage through the spacers and through the springs.

Still with reference to FIGS. 4A and 4B, it can be seen that there is a passage from the space within the bobbin 454A to the connection apparatus 440. It is noted that while the space and the passage are one and the same, in an alternate embodiment, the passage can be different from the space (such as, for example, in an embodiment where the extension assembly 459 is a separate component from the bobbin 454A (e.g., the bobbin 454A and the extension assembly 459 are not monolithic components, as is depicted in FIGS. 4A and 4B), etc.).

Still with reference to FIGS. 4A and 4B, it can be seen that a connection apparatus in the form of coupling assembly 440, is in fixed relationship to the bobbin assembly 454 in general, and the bobbin 454A in particular. In the embodiment depicted in FIG. 4A, the coupling assembly is configured to transfer vibrational energy from the vibrating electromagnetic actuator 450 that is transferred into the extension assembly 459 to an abutment implanted in a recipient (discussed in greater detail below). As noted above, while embodiments detailed herein are directed towards an actuator, other embodiments are directed towards a transducer that receives vibrational energy, and transducers that vibrational energy into electrical output (e.g. the opposite of the actuator). Accordingly, exemplary embodiments include a connection apparatus in fixed relationship to the bobbin configured to transfer vibrational energy to and/or from an electromagnetic transducer. It is noted that in an exemplary embodiment, such a transducer can correspond exactly to or otherwise be similar to the embodiment of FIGS. 4A and 4B.

The embodiment of FIG. 4A depicts intervening component (extension assembly 459) between the coupling assembly 440 and the bobbin assembly 454, such that the coupling assembly 440 is indirectly fixed to the bobbin assembly 454. Accordingly, the coupling assembly 440 indirectly transfers vibrational energy to or from the electromagnetic transducer 450. In an alternate embodiment, the coupling assembly 440 can be directly fixed to bobbin assembly 454. Accordingly, in such an arrangement, coupling assembly 440 transfers vibrational energy directly to or from the electromagnetic transducer 450. Along these lines, while the extension assembly is depicted as being a separate component from the electromagnetic transducer 450, in an alternate embodiment, the bobbin extension can be monolithic with the bobbin 454A, as noted above. Any device, system, or method that can establish a fixed relationship between the bobbin assembly and/or a component of the bobbin assembly and the coupling assembly and/or a component of the coupling assembly can be utilized in at least some embodiments.

Figure 5A:
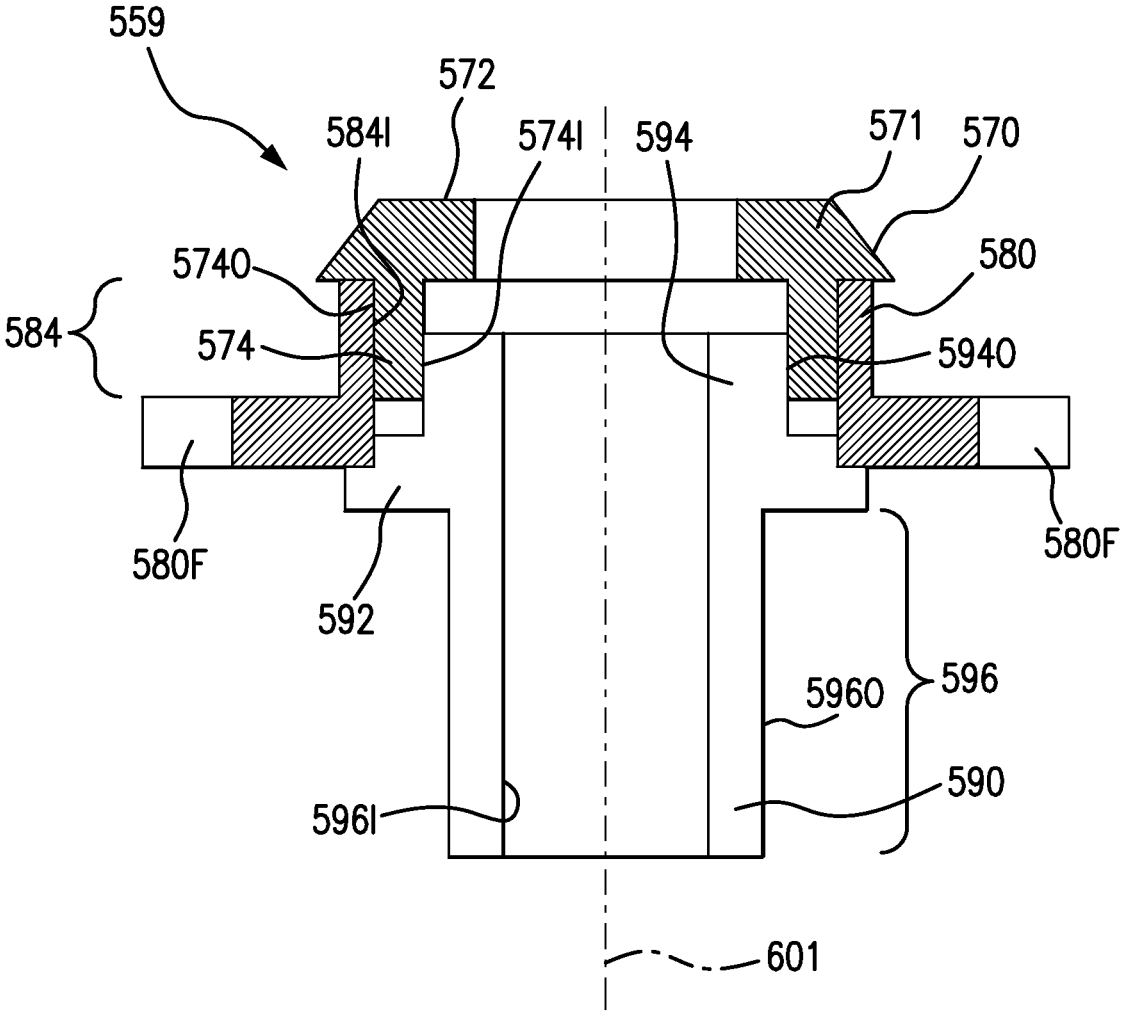
FIG. 5A is a cross-sectional view of a component of FIGS. 4A and 4B.

Referring now to FIG. 5A, an extension assembly 559 is depicted. This extension assembly corresponds to extension assembly 459 *o* FIGS. 4A and 4B, and is depicted without electromagnetic transducer 450 and without connection apparatus 440. As can be seen, extension assembly 559 includes interface apparatus 570 (corresponding to element 470 of FIGS. 4A and 4B), which is connected to stop apparatus 580 (corresponding to element 480 of FIGS. 4A and 4B—details associated with the functionality thereof discussed below) and fastener 590 (corresponding to element 490 of FIGS. 4A and 4B)). In an alternate embodiment, fastener 590 can be directly connected to stop apparatus 410. In an alternative alternate embodiment, fastener 590 can be directly connected to interface adapter 570, and stop apparatus 580 can be directly connected to fastener 590. Note also that in other alternative embodiments, one or more or all of the components of the extension assembly 559 can be combined into a single component (e.g., a monolithic component). Any configuration that can enable the teachings detailed herein and/or variations thereof to be practiced can be utilized in at least some embodiments.

As noted above, embodiments can be practiced that include additional elements that are not depicted in FIGS. 4A, 4B and/or FIG. 5A. By way of example, the spring(s) connecting the housing of the bone conduction device in which the extension assembly 459 is utilized are not depicted. Accordingly, embodiments can include additional components than those depicted and/or described herein. In a similar vein, embodiments can include fewer components than those depicted and/or described herein Still with reference to FIG. 6, the interface adapter 570 includes a top surface 572 that is relatively flat that interfaces with spring 456. In an exemplary embodiment, the top surface 572, along with spacer 424, clamp spring 456 therebetween. It is noted that in an alternative embodiment, where spacer 424 is not utilized, top surface 572 along with bobbin body 454A clamp spring 456 therebetween. Interface adapter 570 includes wall 574 extending from the main body 571 of interface adapter 570 located on the side of the interface adapter 570 opposite from the flat surface 572.

Wall 574 includes an inside surface 574I and an outside surface 574O. In an exemplary embodiment, at least a part of the inside surface 574I forms a cylindrical surface that is threaded to receive a corresponding outer cylindrical surface 594O of fastener 590, at least a portion of surface 594O also being threaded. Conversely, outside surface 574O includes one or more substantially non-uniform surfaces relative to one another. By way of example only and not by way of limitation, outside surface 574O can include one or more planar surfaces, one or more surfaces having a different radius of curvature from that of one or more other services, etc. That said, it is noted that in an alternative embodiment, surface 574O can be cylindrical, at least when additional features are present as will be detailed below. In this regard, any surface that will enable surface 574O to interface with inner surface 584I of stop apparatus 580 such that the teachings detailed herein and/or variations thereof can be practice can be utilized in at least some embodiments. One of these teachings is that the geometries of the surfaces 574O and 584I are such that relative rotation between the interface adapter 570 and the stop apparatus 580 is effectively prevented (which includes totally prevented). In this regard, the respective surfaces form a locking relationship with respect to rotation about longitudinal axis 601 (which is concentrically aligned with longitudinal axis 401 of FIGS. 4A and 4B). The locking relationship between the surfaces enables, in part, the functionality of the stop apparatus 580 as a rotation limiter (a functionality of the stop apparatus) as will be detailed further below.

Along these lines, in at least some embodiments, surface 584I has a surface that is at least effectively opposite that of 574O, and configured to receive surface 574O therein in a male-female relationship. By way of example only and not by way of limitation, if, in totality, outside surface 574O has, for example a square shape, a hexagon shape and/or an octagon shape with respect to a cross-section of interface adapter 570 lying on a plane normal to the longitudinal axis 601 and passing through wall 574, inside surface 584I has, for example, a square shape, a hexagon shape, and/or an octagon shape, respectively, with respect to the aforementioned plane (that also passes through wall 584 of stop apparatus 580). Note further that in at least some embodiments, the shapes do not necessarily correspond to one another. By way of example, with respect to the embodiment where surface 574O has an octagon shape with respect to the aforementioned plane, surface 584I can have a square shape with respect to the aforementioned plane and still effectively prevent relative rotation between the interface adapter 570 and the stop apparatus 580. This is because a properly sized octagon can fit into a properly sized square and prevent rotation albeit there might be less surface to surface contact than that which would be the case if surface 584 I was also an octagon. In some embodiments, the shapes are the same.

It is noted at this time that while the embodiments depicted herein depict interface adapter 570 in a male relationship with respect to stop apparatus 580, which is in a female relationship with respect to interface adapter 570, in alternative embodiments, the opposite can be the case.

As noted above, surface 574O and surface 584 I can be cylindrical. In such embodiments a key can be utilized to prevent rotation between the pertinent components. By way of example only and not by way of limitation, a dowel pin can be inserted through a hole in stop apparatus 580 and through a hole in wall 574 of interface adapter 570. This dowel pin can be aligned normally with respect to the longitudinal axis 601. Alternatively and/or in addition to this, a key can be inserted in a hole that is made up in part by wall 584 and wall 574. Such a key can be a dowel pin that is inserted in this hole that is parallel to the longitudinal axis 601. Because a portion of this key (dowel pin) interfaces with wall 574 and a portion of this key (dowel pin) interfaces with wall 584, relative rotation between the interface apparatus 570 and the stop apparatus 580 is effectively prevented. Any device, system and/or method that can be utilized to effectively prevent relative rotation between the interface adapter 570 and the stop apparatus 580 can be utilized in at least some embodiments.

Figure 5B:
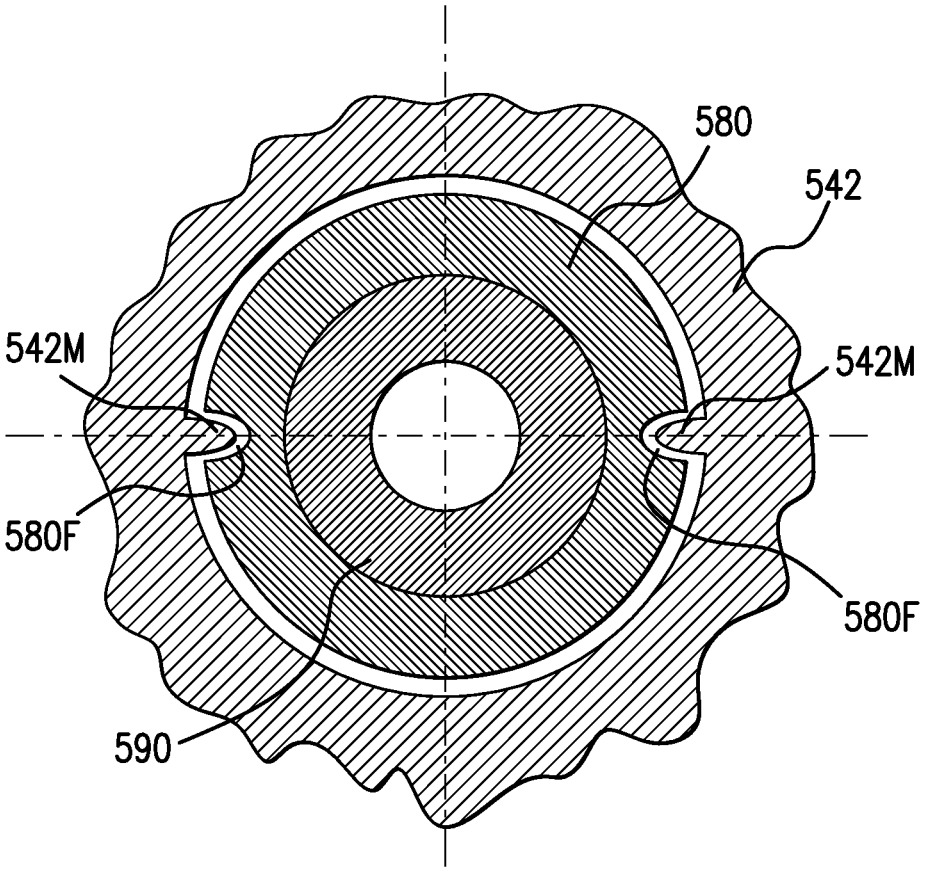
FIG. 5B is a cross-sectional view of another component of FIGS. 4A and 4B.

There is utilitarian value in preventing relative rotation between the interface adapter 570 and the stop apparatus 580 in at least some embodiments because stop apparatus 580 and housing 442 to collectively form a rotation limiter. Referring now to FIG. 5B, FIG. 5B depicts a cross-sectional view through the portion of the removable component of bone conduction device 400 of FIGS. 4A and 4B along section identifier 5B, with element number 542 corresponding to housing 442 and the remaining reference numbers corresponding to those applicable in FIG. 5A. It is noted that only the portions of the housing 542 proximate the extension assembly 559 are depicted, this is in the interests of graphic economy.

The housing 542 and the stop apparatus 580 are dimensioned and configured such that there is a space between these components that enables the components to not contact one another during normal operation and use of the removable component of the bone conduction device 400. That is, in an exemplary embodiment, referring back to the removable component of bone conduction device 200 of FIG. 2, where bone conduction devices 400 correspond to the configuration thereof, spring 244 which can be present in the bone conduction devices 400 holds the housing relative to the vibrating actuator coupling assembly 410 of the bone conduction device 400. This permits limited movement of the housing 542 relative to the vibrating actuator-coupling assembly 410. In this regard, the vibrating actuator-coupling assembly 410 can move in the direction of longitudinal axis 401 relative to the housing 542 a limited amount and can rotate about the longitudinal axis 401 also a limited amount, and/or vice versa, without plastically deforming the spring 244.

Figure 5C:
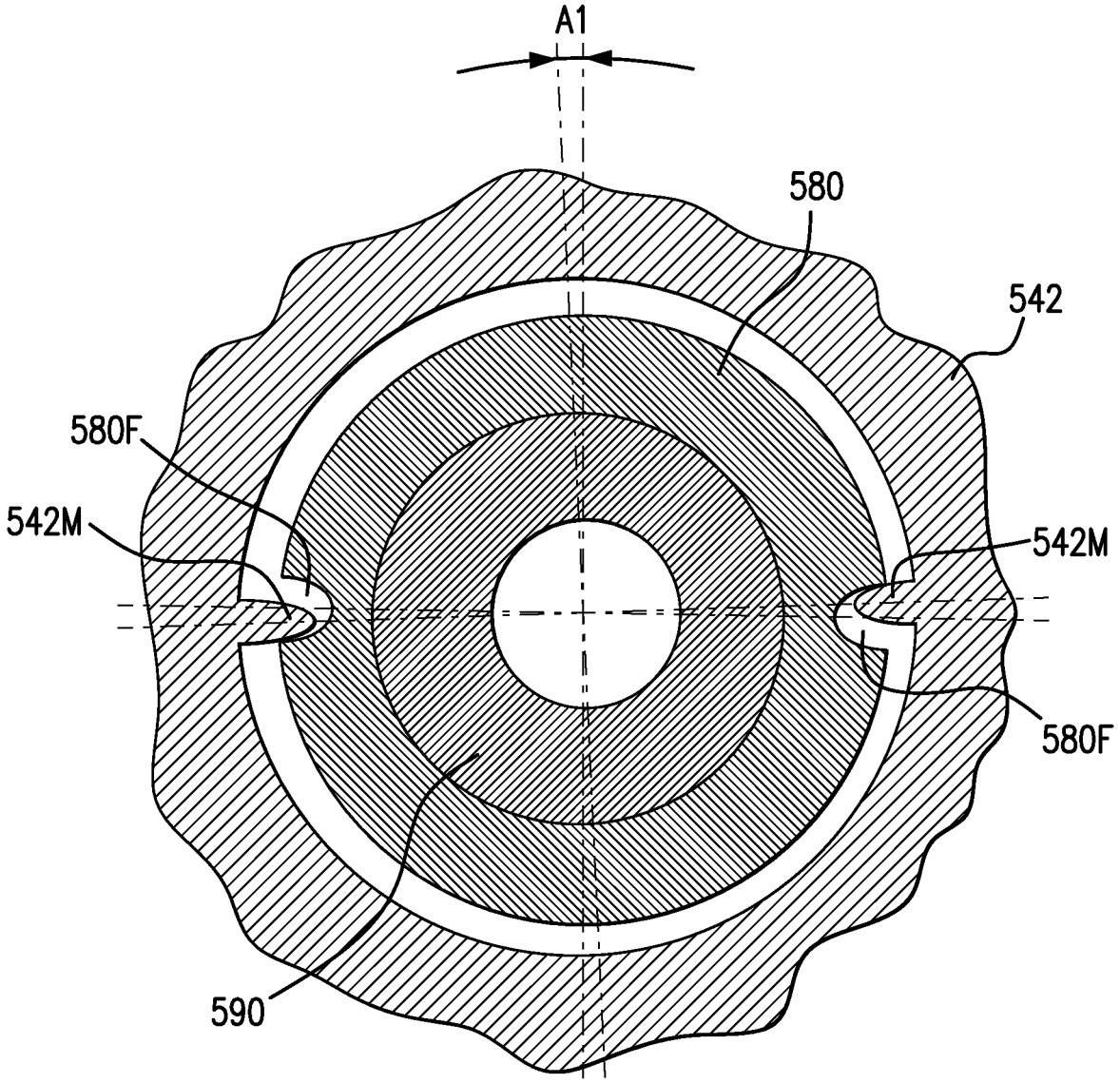
FIGS. 5C and 5D are views of the cross-section of FIG. 5B depicting relative movements of components thereof.
Figure 5D:
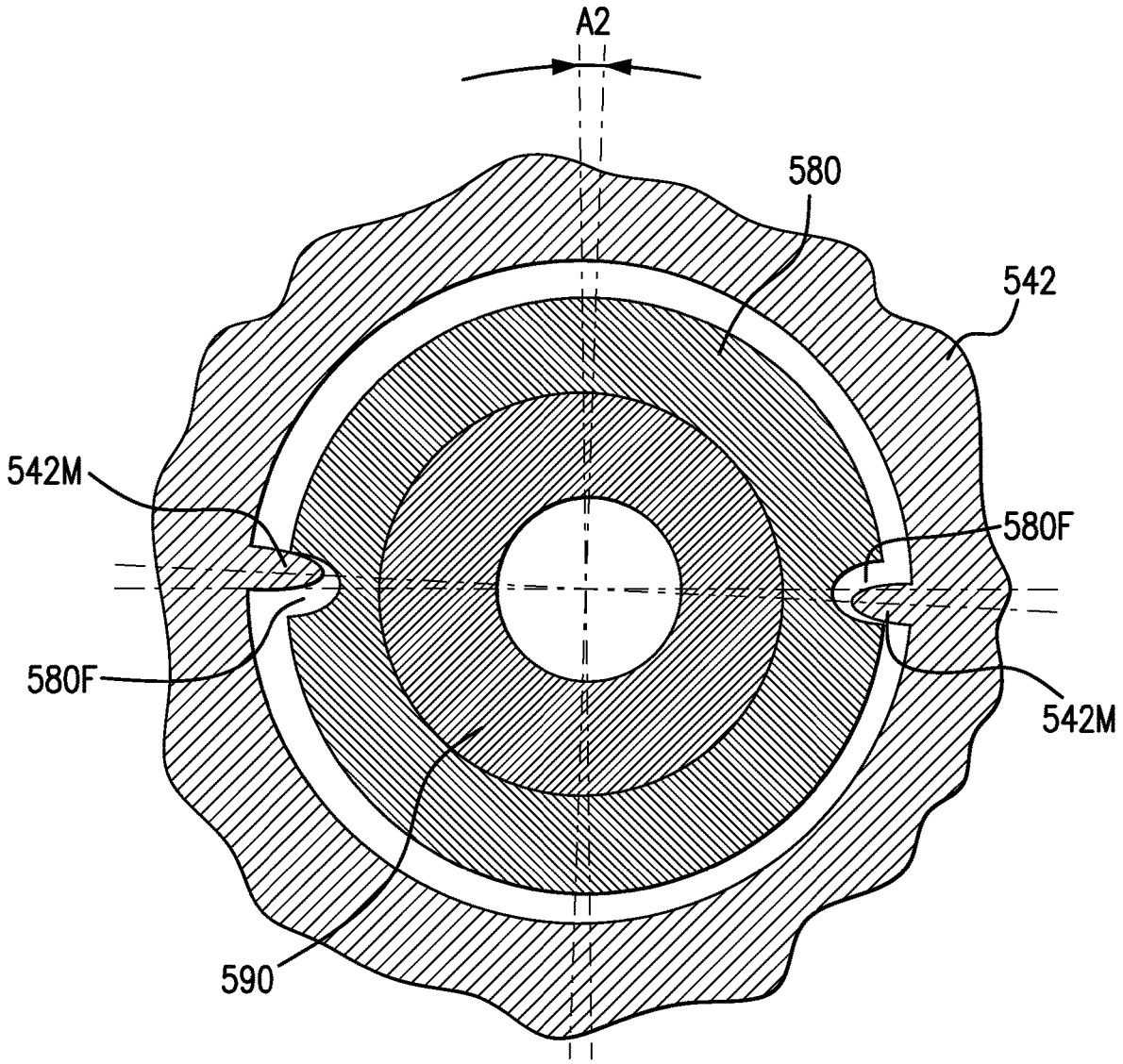

Stop apparatus 580 and housing 542 are dimensioned and configured such that upon a sufficient rotation of one component about longitudinal axis 401 relative to the other component, the components will contact each other, thereby preventing further rotation. This contact occurs prior to the rotation that would result in plastic deformation of the spring or an otherwise deleterious deformation of the spring. Thus, this exemplary embodiment includes a rotation limiter that is configured to limit rotation of the housing 542 relative to the transducer of the removable component of the bone conduction device 400 relative to that which would be the case in the absence of the rotation limiter. Again, in an exemplary embodiment, this has utility in that this prevents the spring 244 from being plastically deformed or otherwise altered such that the bone conduction device might not perform according to the teachings detailed herein and or variations thereof. In this regard, referring now to FIGS. 5C and 5D, it can be seen that an exemplary embodiment prevents or otherwise limits rotation of the housing 542 relative to the extension assembly 559 in general, and the stop apparatus 580 in particular, to angles A1 and A2, respectively, from the at rest position depicted in FIG. 5B. More particularly, as can be seen from the figures, upon a rotation of the housing 542 in the counterclockwise direction (with respect to the frame of reference of FIG. 5C, which entails looking from above the removable component of the bone conduction device 400 of FIGS. 4A and 4B at the removable component 400) an angle of A1, male protrusions 542M will strike the sidewalls of female recesses 580F of the stop apparatus 580, thus preventing further rotation, and thereby protecting the spring 244 from potential damage/deleterious deformation amounts. Conversely, as can be seen from the figures, upon a rotation of the housing 542 in the clockwise direction an angle of A2, male protrusions 542M will strike the sidewalls of female recesses 580F of the stop apparatus 580, thus preventing further rotation, and thereby protecting the spring 244 from potential damage.

Thus, the bone conduction device 400 includes a rotation limiter that comprises or more components 580F in fixed relationship to the transducer 450 and one or more components 542M in fixed relationship to the housing 542 that are configured to rotationally move relative to one another until contact between the respective components, thereby limiting the relative rotation of the housing 542 and the transducer 510. Because of the mating relationship between the components 542M and the 580F, female component 580F defines the extent to which relative rotation of the housing 542 occurs as a result of limiting the movement of the male component 542M therein. Further, bone conduction device includes an apparatus extending from the transducer 410, extension assembly 449, which also extends away from the housing 542, configured to transfer vibrational energy directly or indirectly, at least one of to or from, the transducer 410, wherein there are one or more components 580F (or, in an alternate embodiment, 542M) in fixed relationship to the transducer 410 which are in fixed relationship to the apparatus (extension assembly 449) extending from the transducer 410.

It is noted that the angles A1 and A2 need not be the same. That is, in some embodiments, the rotation limiter of the bone conduction device can be such that the housing can be rotated more in one direction than the other direction. It is further noted that in at least some embodiments, the housing 542 and/or the stop apparatus 580 is dimensioned and configured such that the expected/anticipated movements relative to one another in the longitudinal direction of axis 401 are such that there is always overlap between housing 442/542 and stop apparatus 580 such that rotations between the two corresponding to angles A1 and/or A2 always results in contact between the sidewalls of the female receptacle 580F and the male protrusions 542M, and thus the rotation as always limited to the aforementioned angles.

In alternative embodiments, the configurations can be different than those detailed in the figures. By way of example only and not by way of limitation, the housing 542 can include female recesses, and the stop apparatus 580 can include the male protrusions, and/or both can include one or more male protrusions and/or one or more female recesses. In this regard, it is noted that while the embodiments of the figures are depicted as having two male protrusions and two female recesses, in alternate embodiments there can be more or fewer recesses and protrusions. Also, it is noted that while the male protrusions 542M are depicted as being an integral component of the housing 542, in an alternate embodiment, these projections can be a separate component from the remainder of the housing 542, such as along the lines with the stop apparatus 580 which is a separate component from the remainder of the extension assembly 559. Indeed, in an exemplary embodiment, the bottom portion of the housing 542 is mechanically coupled to the remaining portions of the housing 542 (e.g. by threading, snap fit etc.). In this regard, the bottom portion of the housing 442 containing the stop components (protrusions 542M or recesses in alternative embodiments) can be a lid-like component that closes the remaining cylinder of the housing 442/542. In an exemplary embodiment, the protrusions 542M (or recesses in alternate embodiments) can be monolithic components of at least a substantial portion of the housing 542 (e.g., such as in the embodiment where the components are part of a lid like component). Any device, system, and/or method that can enable rotation between the housing 442/542 and the extension assembly 559 can be utilized in at least some embodiments.

Referring again to FIG. 5A, it is noted in an at least some embodiments, stop apparatus 580 is slip fit onto interface adapter 570. That is, in the absence of positive retention of stop apparatus 580 to interface apparatus 570, stop apparatus 580 easily slides off of interface adapter 570. In an alternative embodiment, stop apparatus 580 is interference fitted or press fitted onto interface adapter 570.

That said, as can be seen in the embodiment of FIG. 5A, stop apparatus 580 is positively retained to interface adapter 570. In this regard, fastener 590 includes projection 592, which extends away from longitudinal axis 601 in a direction normal thereto in all directions thereabouts. In the embodiment of FIG. 5A, projection 592 forms a seat that interfaces with stop apparatus 580 and prevents stop apparatus 580 from moving in the longitudinal direction away from interface adapter 570. More particularly, threads of the fastener 590 in conjunction with the threads of the interface adapter 570 can form a jackscrew effect such that as faster 590 is screwed into interface adapter 570, projection 592 pushes against the bottom surface of stop apparatus 580, effectively clamping stop apparatus 580 between interface adapter 570 and the projection 592 of fastener 590. It is noted that the aforementioned jackscrew effect is but in exemplary embodiment. In an alternative embodiment, where, for example, a press fit arrangement is utilized with respect to the retention of fastener 590 to interface adapter 570, there will be no jack screw effect.

Still with reference to FIG. 5A, fastener 590 includes a lower body 596 that extends away from projection 592. Lower body 596 includes an inner surface 596 I and an outer surface 596O.

In an exemplary embodiment, at least a part of the inside surface 5961 forms a cylindrical surface that is threaded to receive a corresponding outer cylindrical surface 546O of sleeve 544 (see FIG. 5F, where sleeve 544 corresponds to sleeve 444 of FIGS. 4A and 4B), surface 546O also being threaded (discussed in greater detail below). Conversely, outside surface 596O includes one or more substantially non-uniform surfaces relative to one another. By way of example only and not by way of limitation, outside surface 596O can include one or more planar surfaces, one or more surfaces having a different radius of curvature from that of one or more other services, etc. It is noted that in an alternative embodiment, surface 596O can be cylindrical, at least when additional features are present as will be detailed below. In this regard, any surface that will enable surface 596O to interface with inner surface 541I of the snap coupling 541 (see FIG. 5E, where coupling 541 corresponds to coupling 441 of FIGS. 4A and 4B) such that the teachings detailed herein and/or variation of can be practice or otherwise utilized in at least some embodiments. One of these teachings is that the geometries of the surfaces 596O and 541I are such that relative rotation between the fastener 590 and the coupling 541 is effectively prevented (which includes totally prevented). In this regard, the respective surfaces form a locking relationship with respect to rotation about longitudinal axis 601.

Along these lines, in at least some embodiments, surface 541I has a surface that is at least effectively opposite that of 596O. By way of example only and not by way of limitation, if, in totality, outside surface 596O has, for example a square shape, a hexagon shape and/or an octagon shape with respect to a cross-section of fastener 590 lying on a plane normal to the longitudinal axis 601 and passing through lower body 596, inside surface 541I has, for example, a square shape, a hexagon shape, and/or an octagon shape, respectively, with respect to the aforementioned plane (that also passes through section 543 of coupling 541). Note further that in at least some embodiments, the shapes do not necessarily correspond to one another. In this regard, reference is made to the teachings above with respect to the interface adapter 570/stop apparatus 580 mating surfaces. It is noted that in some embodiments, the surfaces can have the same shape.

It is noted at while the embodiments depicted herein depict fastener 590 in a male relationship with respect coupling 541 (and thus a portion of the protective sleeve—the portion that forms surface 546O—is located within the passage from the space inside the transducer 550 to the sleeve 544), which is in a female relationship with respect to fastener 590, in alternative embodiments, the opposite can be the case.

As noted above, surface 596O and surface 541 I can be cylindrical. In such embodiments a key can be utilized to prevent rotation between the pertinent components. By way of example only and not by way of limitation, the concepts detailed above with respect to utilization of the dowel pin or the like to prevent relative rotation of the stop apparatus 580 relative to interface adapter 570 can be utilized.

It is noted in an at least some embodiments, coupling 541 is slip fit onto fastener 590. That is, in the absence of positive retention of coupling 541 to fastener 590, coupling 541 easily slides off the fastener 590.

That said, as can be seen in the embodiments of FIGS. 4A and 4B, coupling 441 (coupling 541 of FIG. 5E) is positively retained to fastener 490 (590 of FIG. 5A). In this regard, sleeve 544 includes shoulder 545 which extends outward away from longitudinal axis 601 in all directions thereabouts. In the embodiment of FIGS. 4A and 4B, shoulder 545 forms a seat that interfaces with coupling 441 and prevents coupling 441 from moving in the longitudinal direction away fastener 490. More particularly, surface 546O is threaded. These threads corresponds to the threads of surface 596 I. When these two components are threaded together, a jackscrew effect exists such that as sleeve 544 is screwed into fastener 590, shoulder 545 pushes against the bottom surface 548 of coupling, effectively clamping coupling 541 between sleeve 544 and the bottom surface of projection 592 of fastener 590. It is noted that the aforementioned jackscrew effect is but in exemplary embodiment. In an alternative embodiment, where, for example, a press fit arrangement is utilized with respect to the retention of coupling 541 relative to fastener 590, there might be no jack screw effect.

Accordingly, in an exemplary embodiment, there is a bone conduction device according to any of the teachings detailed herein and/or variations thereof that includes a transducer such as the electromagnetic transducer 410 of the embodiments of FIGS. 4A and/or 4B or any other type of transducer they can be utilized to practice the teachings detailed herein and/or variations thereof. The bone conduction device further includes a connection assembly in fixed relationship with the transducer. The connection assembly is configured to connect the bone conduction device to another component configured to directly and/or indirectly interface with the recipient of the bone conduction device. Examples of such connection are detailed below with respect to FIGS. 6 and 7. Briefly, however, an exemplary embodiment of such a connection assembly is the coupling 441 snap coupled to abutment 620 (or another type of skin penetrating component) as detailed in FIG. 6.

By way of example only and not by way of limitation, the connection assembly can include the coupling 441 and sleeve 444 of the embodiments of FIGS. 4A and/or 4B, etc. As detailed above, the connection assembly is configured to transfer vibrational energy directly or indirectly to and/or from the transducer. In this regard, the embodiments of FIGS. 4A and 4B, utilizing the extension assembly 459, are examples of embodiments that indirectly transfer vibrational energy to and/or from the transducer 450 in view of the fact that the extension assembly 459 is interposed between and mechanically connects the coupling 441 to the electromagnetic transducer 450. Conversely, in embodiments where the coupling 441 directly abuts the electromagnetic transducer 450, there is, at least in part direct transfer of vibrational energy to and/or from the transducer (it is quote at least in part) because a scenario can exist where there is also a path of indirect transmission of vibrational energy, such as through a component that extends from the electromagnetic transducer 450 to the coupling 441 (e.g. a bolt fastening the two components together etc.).

In an exemplary embodiment, a component of the connection assembly, such as by way of example the coupling 441, is actively held by positive retention to the bone conduction device by another component of the connection assembly, such as by way of example the sleeve 444. By "actively held by positive retention," it is meant that the other component of the connection assembly provides the retention of the component to the device such that in the absence of that another component, the component would not be positively retained to the bone conduction device. By way of example only and not by way of limitation, if the coupling 441 is slip fit onto the faster 490, the sleeve 444 actively holds the coupling 441 to the bone conduction device by positive retention. Conversely by way of example only and not by way of limitation, if the coupling 441 is threaded to the faster 490 and/or otherwise interference fitted to the faster 490 such that the bone conduction device could be effectively utilized to evoke a hearing percept without positive retention by another device (e.g. the sleeve 444), there would be no active holding by positive retention by the coupling 441 because the coupling 441 holds itself to the bone conduction device and permits the bone conduction device to effectively evoke a hearing percept. Put another way, if the coupling 441 can be held to the bone conduction device in the absence of the sleeve 444, and the bone conduction device can effectively be used to evoke a hearing percept, and there is no other component that provides positive retention to the coupling 441, there is no active holding by positive retention of the coupling 441 by second device, even though the coupling 441 is indeed held by positive retention (the threads, but the threads but this is done by the coupling 441 itself).

In some embodiments, sleeve 444/549 includes a screw driver receptacle (flat or Phillips or other type) or a wrench receptacle (e.g., Allen wrench). In an exemplary embodiment, with reference to FIG. 5F, driver receptacle can be located at surface 549 of sleeve 544. In this regard, in an exemplary embodiment, a screwdriver can be fitted into the opening 551 (female portion) of the sleeve 544 to access the driver receptacle at surface 549. By applying a torque to the screwdriver, which torque is reacted against by the receptacle at surface 549, the sleeve 544 is screwed into fastener 590. In an alternative embodiment, instead of or in addition to receptacles, a wrench stud (e.g., hex head protrusion) is included with the sleeve 544, which wrench stud can be located at surface 549. Any device, system, and/or method that can enable mechanical advantage to be applied to the sleeve 544 to enable the sleeve to be threaded into the faster 590 can be utilized in at least some embodiments.

In an embodiment, the coupling 441 is a component that wears during the use of the bone conduction device over a period of time. By way of example only and not by way of limitation, a bone conduction device can be used, albeit intermittently, over a period of 1, 2, 3, 4 or 5 or more years. In at least some exemplary scenarios, the bone conduction device will be attached the recipient via the abutment 620 (with reference to FIG. 6) or other component at least once per day because the recipient will be removing the bone conduction device from himself or herself one day if only prior to going to bed. Because, in some embodiments, the coupling 441/541 is made out of plastic or a material that is otherwise relatively substantially less hard than the material of the abutment 620 (which in some embodiments is made out of titanium and/or other types of metals), the coupling 441 can, in some embodiments, wear such that the effectiveness of the bone conduction device is at least partially degraded from that which would be the case in the absence of a non-worn coupling 441. In an exemplary embodiment, degradation of effectiveness can exist when the resonant frequency of the assembly of the bone conduction device when coupled to the recipient via the abutment 620 or other type of device is changed from that which is desirable. Such change can occur as a result of wear of the coupling 441. In an exemplary embodiment, a change of about 5%, 10%, 15%, and/or 20% can correspond to a significant change in the resonant frequency warranting replacement of the coupling 441, at least when such change is at least substantially due to wear of the coupling/damage of the coupling.

Accordingly, in an exemplary embodiment, the coupling 441 is a replaceable/removable component from the remainder of the bone conduction device. In an exemplary embodiment, there is utilitarian value in constructing the bone conduction device such that the coupling 441/541 is relatively easy to remove and a new coupling 441/541 is relatively easy to install onto the removable component of the bone conduction device. Indeed, in an exemplary embodiment, the coupling 541 can be removed from the rest of a fully operational removable component of a bone conduction device in a configuration for use for normal every day evoking of a hearing precept (normal operation) without removing any other components except those components that positively retained the coupling 441/541 to the remainder of the bone conduction device. That is, with respect to the embodiments of FIGS. 4A and/or 4B, the removable component of the bone conduction device is configured such that the coupling 441 can be removed from the remainder of the bone conduction device by only removing the sleeve 444 or, in some embodiments, only an access component of the housing 442 to access passage 554D in the case that the sleeve 444 is press-fit to the fastener 490 or in the case where a screwdriver receptacle is located on the opposite side of the sleeve 444/544 from surface 549, etc. For example, a screw plug can be present on the top of the housing, aligned with axis 401, which screw plug can be unscrewed to access the passage with an elongated tool (screw driver, wrench, punch, drift, etc.). Still further, in an exemplary embodiment, still with respect to the embodiments of these figures, the removable component of the bone conduction devices is configured such that a new coupling 441 can be installed onto the remainder of the removable component of the bone conduction device after the old coupling 441 is removed, and the coupling 441 can be actively positively retained to the remainder the device via the attachment of sleeve 444 to the remainder of the removable component of the bone conduction device (a new sleeve 444 or the old sleeve 444 can be utilized in at least some embodiments).

That is, in an exemplary embodiment, the coupling 441 can be removed from the faster 490 with the fastener 490 attached to the interface adapter 470 and/or the stop apparatus 480 while the interface adapter 470 and/or stop apparatus 480 is in fixed relationship to the electromagnetic transducer and is in mechanical coupling relationship with the housing 442.

Further, sleeve 444 is an item that can be subject to wear and/or structural fatigue and or fracture (e.g., if the sleeve 444, which can be made out of plastic, is pressed too hard against the abutment wall, which is typically made of titanium or another metal). Accordingly, in some embodiments, it is utilitarian to be able to remove the sleeve 444 from the rest of the removable component of the bone conduction device and replace the sleeve 444 with a new sleeve (in an exemplary embodiment, this is the case without removing, for example, coupling 441). Of course, in an alternative embodiment, the sleeve 444 may not "need" to be replaced (e.g., the condition thereof is still functional), but its removal is utilitarian in that it permits access to another component and/or permits another component, such as the coupling 441, to be removed, or otherwise more easily removed, as compared to removal of that component without removal of the sleeve. In some embodiments, it is utilitarian to be able to replace the sleeve 444 without disassembling and/or significantly disassembling the bone conduction device. For example, in an exemplary embodiment, it is utilitarian to only remove the sleeve 444 from the rest of the bone conduction device.

Figure 6:
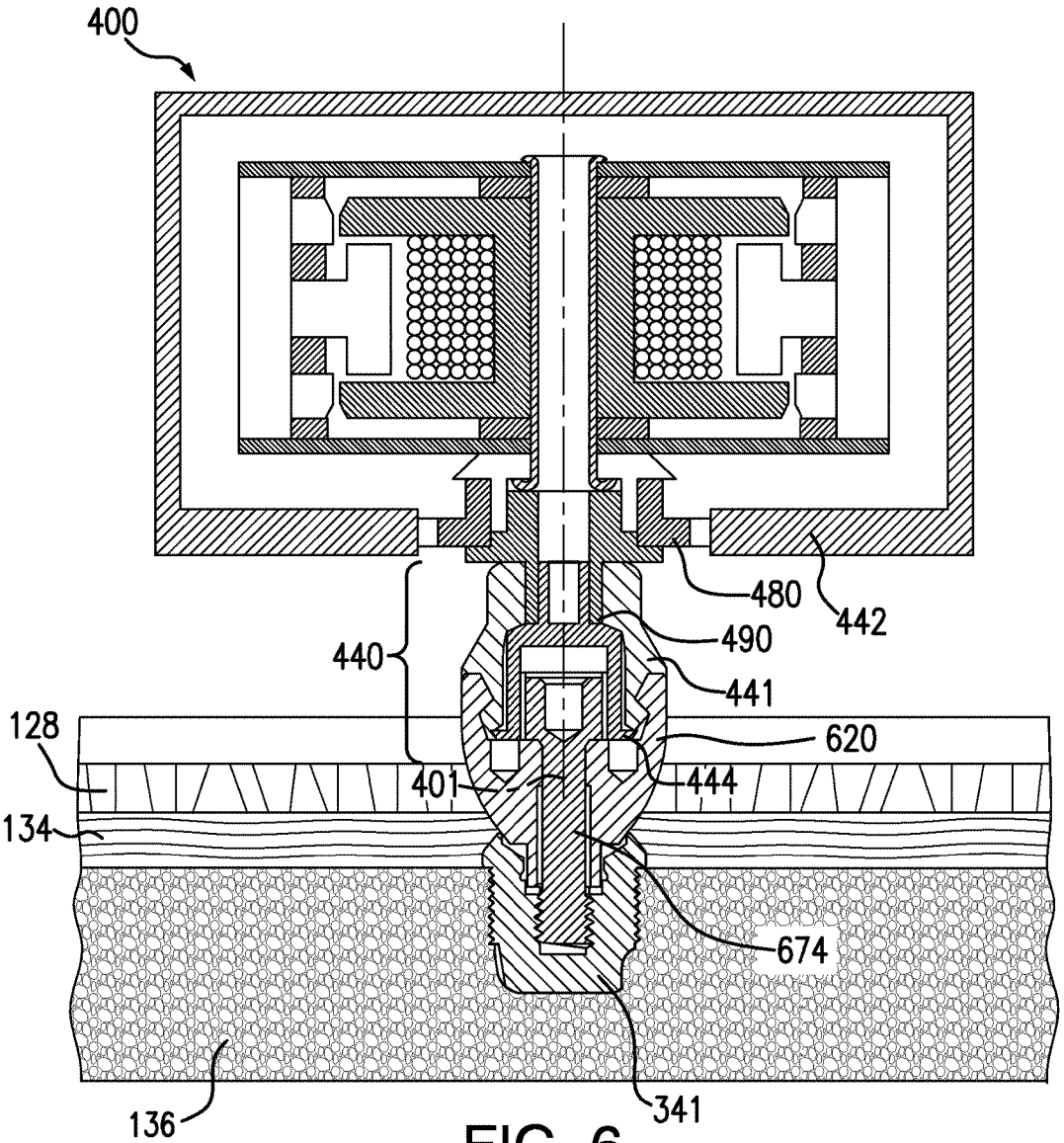
FIG. 6 is a schematic diagram illustrating connection of the removable component of FIG. 4A to and implanted abutment.

FIG. 6 depicts use of the embodiment of FIGS. 4A and 4B to provide vibrational energy into bone 136 of a recipient via vibrating electromagnetic actuator-coupling assembly 410. More particularly, FIG. 6 shows the coupling assembly 440 snap-coupled to abutment 620, which is secured to bone fixture 341 via abutment screw 674 (all of which can be made from titanium/titanium alloys, in whole or in substantial part). In operation, vibrational energy generated by the vibrating electromagnetic transducer 550 travels down bobbin extension 559 into the coupling assembly 540, including coupling 540, and then from coupling assembly 540 to the abutment 620 and then into bone fixture 341 and then into bone 136. In an exemplary embodiment, the vibrational communication effectively evokes a hearing percept. Accordingly, the electromagnetic transducer 450 of the bone conduction device (elements 400 in combination with elements 620, 274 and 341) is an electromagnetic actuator. However, as noted above, in alternate embodiments, electromagnetic transducer 450 receives vibrations from a recipient or the like.

Figure 5E:
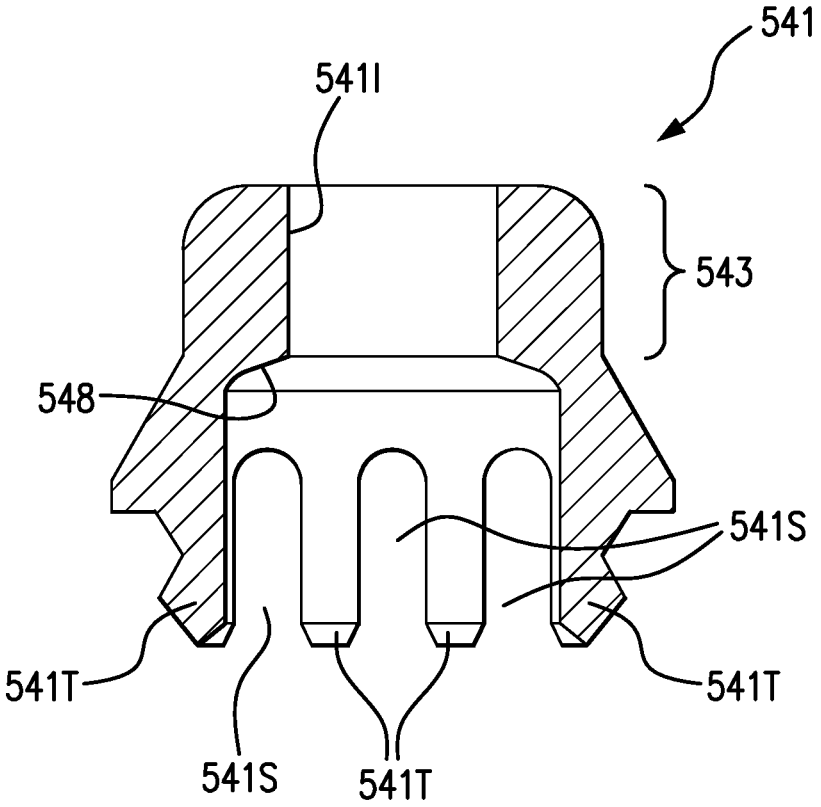
FIG. 5E is a cross-sectional view of another component of FIGS. 4A and 4B.

In an exemplary embodiment, the abutment is a generally concave component having a hollow portion at a top thereof into which the coupling assembly 440 fits (with reference to FIG. 5E, teeth 541T of the coupling assembly 540 fit into the hollow portion). The hollow portion has an overhanging portion at the end of the abutment around which teeth 541T of the coupling extend to snap-fit to the abutment. While an exemplary embodiment of the abutment entails a challis shaped outer profile, other embodiments can be substantially cylindrical or hour-glass shaped, etc.

It is noted that while the embodiment of the coupling assembly 440 detailed herein is directed to a snap-fit arrangement, in an alternate embodiment, a magnetic coupling can be used. Alternatively, a screw fitting can be used. In some embodiments, the coupling assembly 440 corresponds to a female component and the abutment corresponds to a male component, in some alternate embodiments, this is reversed. Any device, system or method that can enable coupling of the removable component to an implanted prosthesis can be utilized in at least some embodiments providing that the teachings detailed herein and/or variations thereof can be practiced.

As noted above, any removable component of the bone conduction device 400 includes a protective sleeve 444 that is part of the coupling assembly 440. In this regard, coupling 441 is a male portion of a snap coupling that fits into the female portion of abutment 620, as can be seen in FIG. 6.

Referring to FIG. 5E, the outer circumference of coupling 441 has spaces 541S between teeth 541T at the bottom portion thereof (i.e. the side that faces the abutment 620) in a manner analogous to the spaces between human teeth, albeit the width of the spaces are larger in proportion to the width of the teeth as compared to that of a human. During attachment of the bone conduction device to the abutment 620, the potential exists for misalignment between the abutment 620 and the coupling 441/541 such that the outer wall that establishes the female portion of the abutment 620 can enter one or more of the spaces 541S between the teeth 541T of the coupling 441/541 (analogous to the top of a paper cup (albeit a thin paper cup) passing into the space between two human teeth). In some embodiments, this could have a deleterious result (e.g., teeth might be broken off if the components are moved in a lateral direction during this misalignment (which is not an entirely implausible scenario, as percutaneous bone conduction devices are typically attached to a recipient behind the ear, and thus the recipient cannot see the attachment), etc.).

Figure 5F:
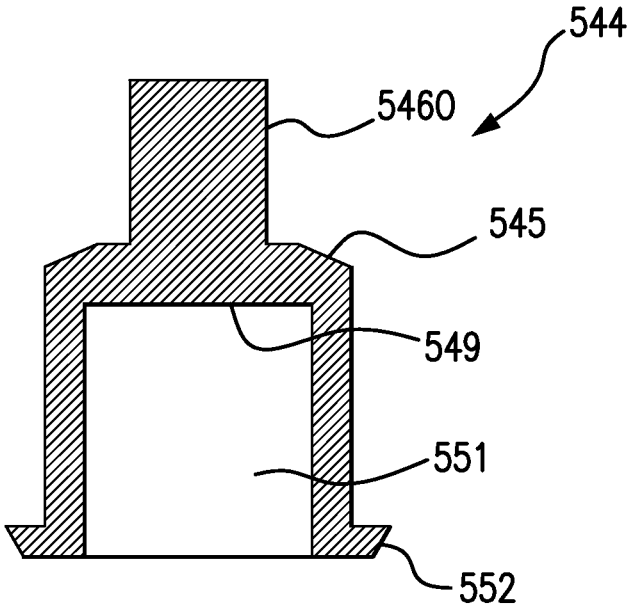
FIG. 5F is a cross-sectional view of another component of FIGS. 4A and 4B.

With reference to FIG. 5F, sleeve 444/544 is a solid sleeve with a portion 552 that juts out in the lateral direction such that it is positioned between the very bottom portion of coupling 541 and the abutment 620. The portion 552 that juts out, because it is continuous about the radial axis/axis 601 (e.g., no spaces, unlike the teeth) prevents the wall forming the female portion of the abutment 620 from entering between the teeth of the coupling 441/541. (This is analogous to, for example, placing a soft plastic piece generally shaped in the form of a "U" against the tips of a set of human bottom or top teeth. Nothing moving in the longitudinal direction of the teeth can get into the space between the teeth because it will first hit the "U" shaped plastic.) In this regard, the removable component of the bone conduction device 400 includes a connection apparatus 440 that in turn includes a protective sleeve 444 configured to limit a number of interface regimes of the connection apparatus with the abutment 620. In an exemplary embodiment, this is the case at least with respect to those that would otherwise exist in the absence of the protective sleeve 444 (e.g. in the absence of the sleeve, the wall of the abutment could fit into the space between the teeth of coupling 441—with the sleeve, the wall of the abutment cannot fit into the space between the teeth of coupling 441).

As noted above, in an exemplary embodiment, the removable component of the bone conduction device 400 is configured such that access to the sleeve 444 can be obtained through the space 454D in bobbin 554A. Referring back to FIGS. 4A and 4B, as noted above, it can be seen that there is a passageway that extends from the space to the coupling assembly 440 in general, and the sleeve 444 in particular. In addition, there is a passageway that extends from the space in the bobbin 454A through spacer 422 and through spring 457. Thus, there is a passageway extending from a side of the vibrating electromagnetic transducer-coupling assembly 410 facing away from the coupling assembly 440 to a side of the assembly 410 facing the coupling assembly 440.

With respect to the embodiments of FIGS. 4A and 4B, it is noted that the sleeve 444 is screw-fit into the hollow portion of extension assembly 459 in general, and fastener 490 in particular. In an alternate embodiment, the sleeve 444, or at least the portion of the sleeve having surface 4460, is interference-fit (e.g., press fit) into the hollow portion in general, and the fastener 490 in particular. In an exemplary embodiment, the sleeve 444 press-fit into the passage, wherein a force of 20-50 Newtons or more (and, in some embodiments, these values are multiplied by a safety factor) are applied to the protective sleeve through the passage is required to remove the protective sleeve from the passage.

In this regard, an outer diameter of the sleeve 444 (the outer diameter of surface 4460 that fits in the hollow portion of the bobbin extension 454A is larger, at a given temperature, then the interior interfacing diameter of that hollow portion at that same temperature. In an exemplary embodiment, the attachment depicted in FIGS. 4A and 4B is achieved by a press-fit, while in an alternative embodiment, the attachment depicted in FIGS. 4A and 4B is achieved via a shrink-fit and/or an expansion-fit (achieved via for example temperature differentiation of the components). It is noted that in an alternate embodiment, sleeve 444 is slip-fit to the extension assembly 459, and an adhesive or the like is used to secure sleeve 444 to extension assembly 459.

It is noted that while the embodiment of FIGS. 4A and 4B are depicted has having a snap-coupling, in an alternate embodiment, the coupling could be magnetic. As noted above, any device, system or method that can enable coupling of the removable component to an implanted prosthesis can be utilized in at least some embodiments providing that the teachings detailed herein and/or variations thereof can be practiced. In this regard, in an exemplary embodiment, a magnet or other ferromagnetic material can be press-fit or interference fit, or screw fit, etc., into the passageway. Removal of the ferromagnetic material can be akin to the removal teachings with respect to the sleeve detailed herein and/or variations thereof.

Figure 7:
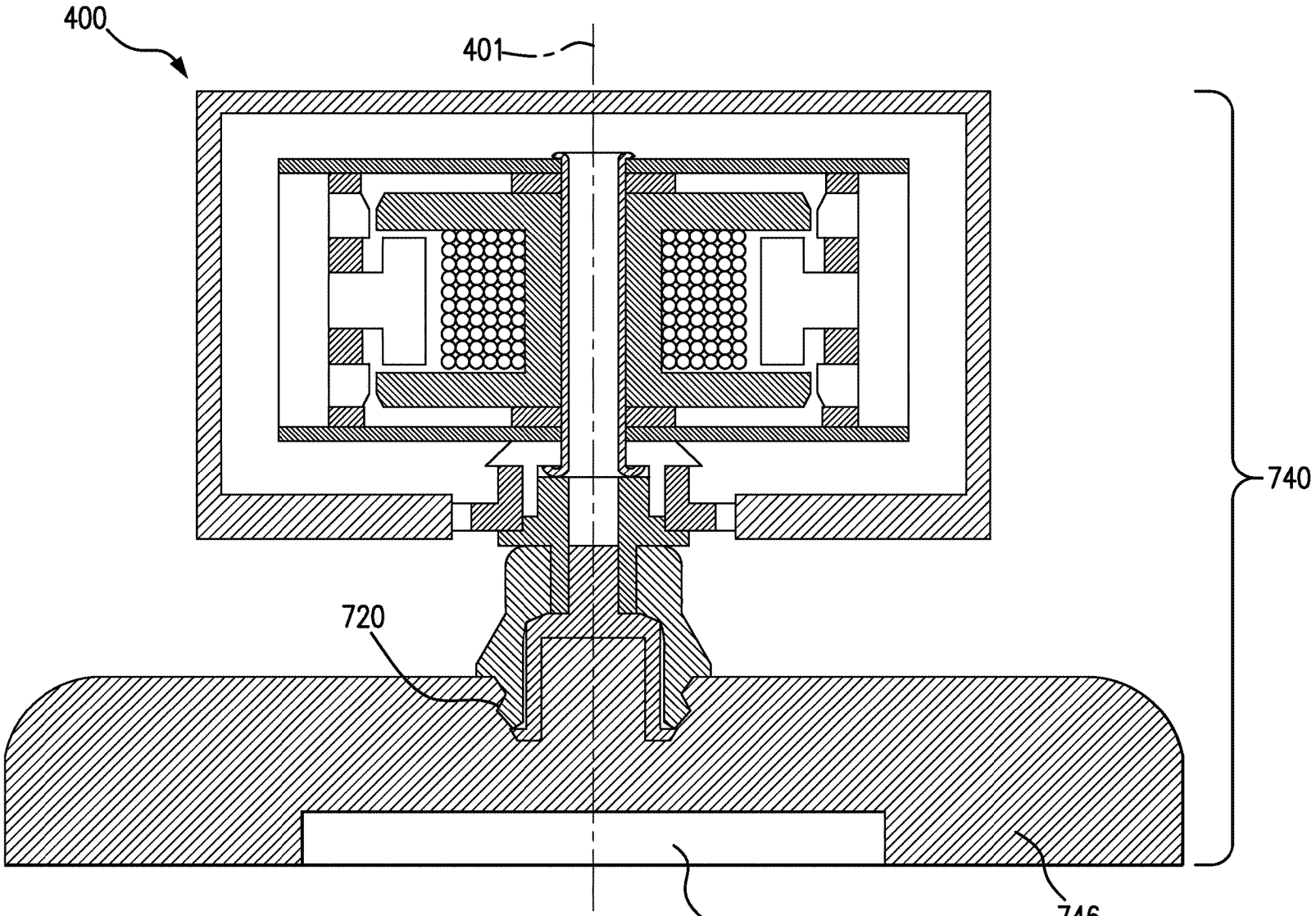
FIG. 7 is a cross-sectional view of an example of the external component of the embodiment of FIG. 3.

While the embodiments detailed herein up to this point have tended to focus on percutaneous bone conduction devices, variations of these embodiments are applicable to passive transcutaneous bone conduction devices. In this regard, the fixation regimes and methods described herein and/or variations thereof are applicable to fixation of an electromagnetic transducer to a pressure plate of a passive transcutaneous bone conduction device, such as the plate 346 of FIG. 3, where a vibrating electromagnetic actuator 342 is the electromagnetic transducer. This can be the case in an exemplary embodiment where such connection results in an interface between the given electromagnetic vibrator and the plate 346 that is sufficient to establish a vibrational communication path such that, providing a suitable interface between the plate 346 and the vibratory portion 355, the vibrational communication effectively evokes a hearing percept. In an exemplary embodiment, the plate can have a component analogous to or the same as the portions of the fixture 341 that interface with the bone conduction device 400 detailed above or variations thereof. Along these lines, FIG. 7 depicts an exemplary embodiment of an external component 740 of a passive transcutaneous bone conduction device according to that of FIG. 3. As can be seen, device 400 of FIGS. 4A and 4B is attached to a plate 746 (corresponding to plate 346 of FIG. 3) via receptacle 720 of plate 746, where receptacle 720 corresponds to the interior of abutment 620 of FIG. 6. In an exemplary embodiment, receptacle 720 is a monolithic component of plate 746, whereas in an alternate embodiment, it is a separate component. Indeed, in an exemplary embodiment, it can correspond to, in part or in whole, abutment 620.

Plate 746 includes magnet 747, which corresponds to the magnet of external device 340 of FIG. 3. In an alternate embodiment, all or substantially all of plate 746 is a magnet.

Some additional geometric features of some embodiments will now be described, which geometric features can have utilitarian value with respect to electrostatic discharge (detailed further below).

Figure 8:
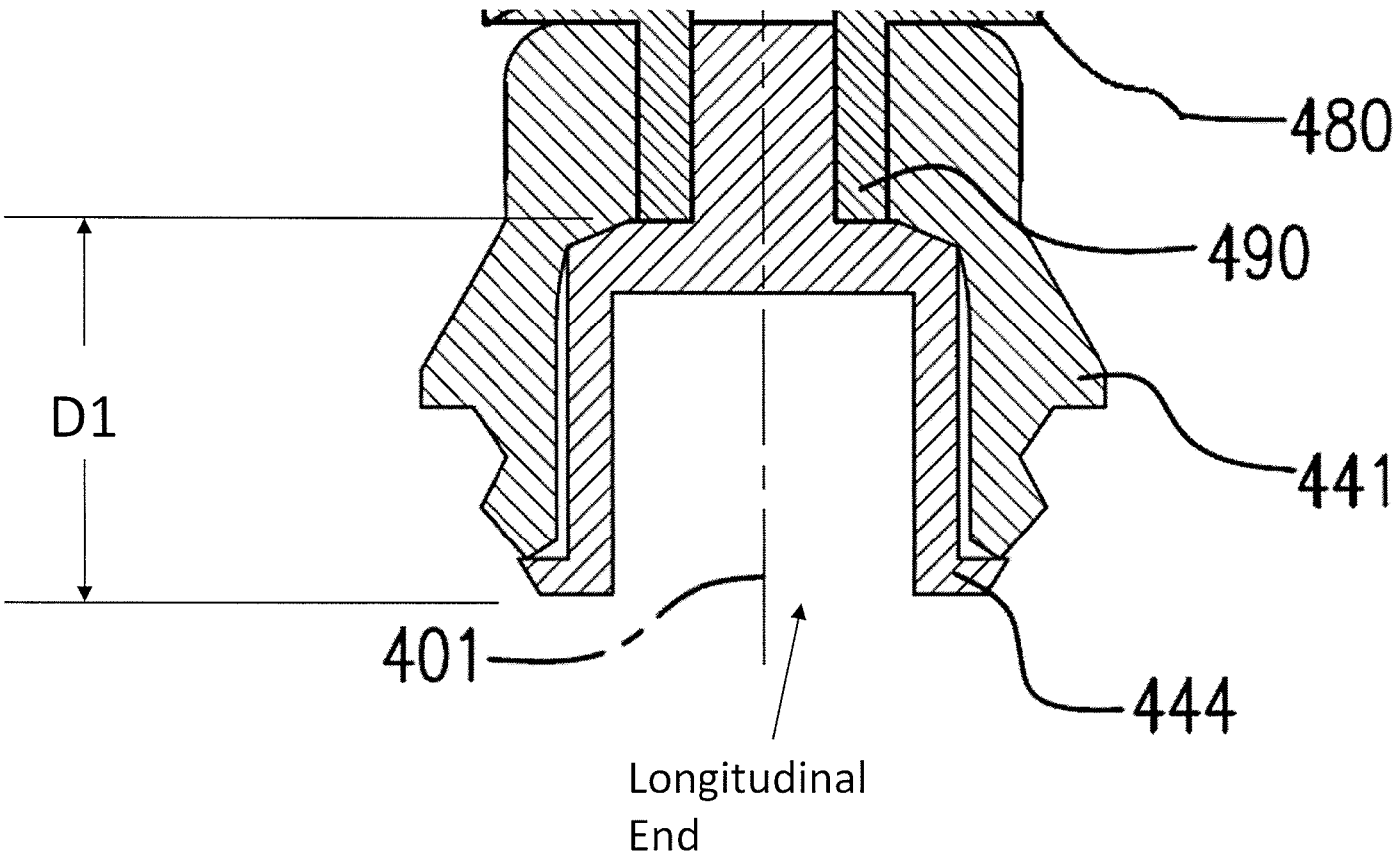
FIGS. 8 and 9 depict close-up views of portions of FIGS. 4A and 6, respectively.

In an exemplary embodiment, there is a removable component of a bone conduction device, such as by way of example the removable components 400 of FIGS. 4A and 4B. The device includes a connector, such as coupling assembly 440, configured to removably connect the removable component to a recipient skin penetrating component, such as abutment 620 of FIG. 6. In the exemplary embodiment, the removable component of the bone conduction device 400 does not include any metallic components within at least about 3 mm from a longitudinal end of the removable component on the connector side thereof (i.e., the side of the device on which the coupling assembly 440 is located). Along these lines, FIG. 8 depicts a close-up view of the longitudinal end of the removable component of bone conduction device 400 of FIGS. 4A and 4B. Dimension D1 is the distance from the longitudinal end of the removable component of bone conduction device 400 and the end of the fastener 490 closest to the longitudinal end. In an exemplary embodiment, fastener 490 is substantially made out of metal (steel, aluminum, titanium, etc.). Thus, dimension D1 represents the closest approach of a metallic component of the bone conduction device 400 to the longitudinal end of the bone conduction device 400. (Coupling 441 is plastic, as noted above, at least in some embodiments.) In some embodiments, the coupling 441 is made at least substantially entirely out of PEEK.

In an exemplary embodiment, dimension D1 is 3 mm. In an alternative embodiment dimension D1 is 3 mm or more than 3 mm. In some alternate embodiments, dimension D1 is 2 millimeters or more than 2 mm. In an exemplary embodiment, dimension D1 is about 2.0 mm, 2.1 mm, 2.2 mm, 2.3 mm, 2.4 mm, 2.5 mm, 2.6 mm, 2.7 mm, 2.8 mm, 2.9 mm, 3.0 mm, 3.1 mm, 3.2 mm, 3.3 mm, 3.4 mm, 3.5 mm, 3.6 mm, 3.7 mm, 3.8 mm, 3.9 mm, 4.0 mm, 4.1 mm, 4.2 mm, 4.3 mm, 4.4 mm, 4.5 mm, 4.6 mm, 4.7 mm, 4.8 mm, 4.9 mm, 5.0 mm or more, or any value or range of values between any of these values in 0.05 mm increments (e.g., about 3.25 mm, about 2.85 mm to about 3.60 mm, etc.) Any distance that can enable the teachings detailed herein and/or variations thereof with respect to the electromagnetic discharge as discussed below can be utilized in at least some embodiments, etc.

Figure 9:
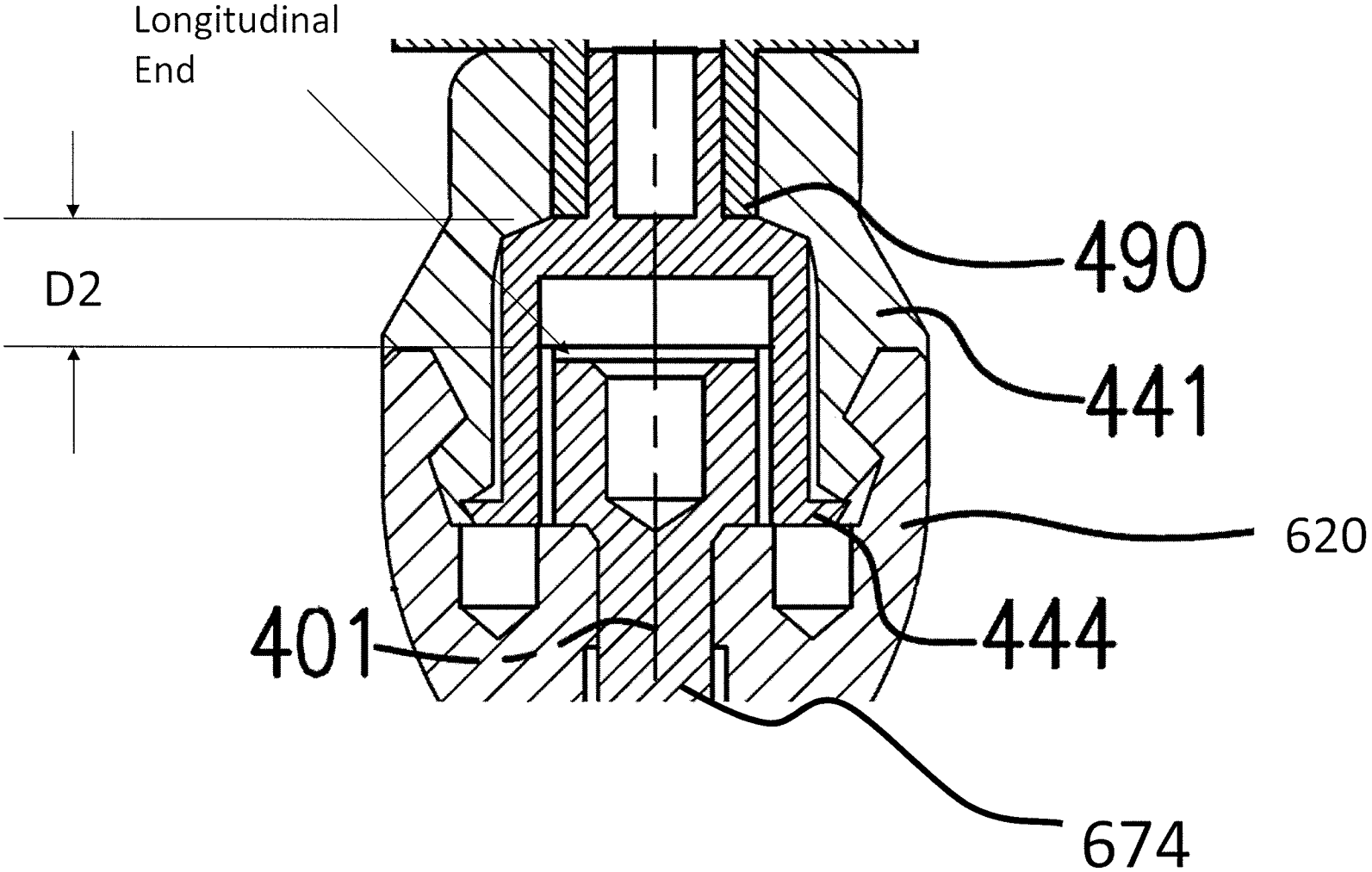

Referring now to FIG. 9, there is a close-up view of a portion of FIG. 6, with certain elements removed for clarity. FIG. 9 bears the dimension D2, which represents the shortest distance between the fastener 490 and a portion of the implanted component (abutment 620, abutment screw 674, bone fixture 341, etc.), which in this case, is the longitudinal end of the abutment screw 674 (the upper surface of head of the abutment screw 674), when the removable component of bone conduction device 400 is operationally coupled to abutment 620. In an exemplary embodiment, dimension D2 is 1.5 mm. In an alternative embodiment, dimension D2 is 1.5 mm or more than 1.5 mm. In some alternate embodiments, dimension D2 is 1 mm or more than 1 mm. In an exemplary embodiment, dimension D2 is about 1.0 mm, 1.1 mm, 1.2 mm, 1.3 mm, 1.4 mm, 1.5 mm, 1.6 mm, 1.7 mm, 1.8 mm, 1.9 mm, 2.0 mm, 2.1 mm, 2.2 mm, 2.3 mm, 2.4 mm, 2.5 mm, 2.6 mm, 2.7 mm, 2.8 mm, 2.9 mm, 3.0 mm, 3.1 mm, 3.2 mm, 3.3 mm, 3.4 mm, 3.5 mm, 3.6 mm, 3.7 mm, 3.8 mm, 3.9 mm, 4.0 mm or more, or any value or range of values between any of these values in 0.05 mm increments (e.g., about 2.25 mm, about 1.85 mm to about 2.60 mm, etc.) Any distance that can enable the teachings detailed herein and/or variations thereof with respect to the electromagnetic discharge as discussed below can be utilized in at least some embodiments, etc.

In an exemplary embodiment, the aforementioned geometries related to the longitudinal end of the removable component of bone conduction device 400 can have utilitarian value in that there is improved resistance with respect to electrostatic discharge, at least with respect to such that can damage the components of the bone conduction device and or cause a sensation of pain or otherwise discomfort in the recipient during attachment/coupling of the removable component of the bone conduction device to the skin penetrating component. More particularly, in an exemplary embodiment, a human recipient might conceivably develop a static electric charge (e.g., by walking across a wool carpet without lifting his or her feet off the carpet in a room with a relative humidity of 25%). Alternatively, the removable component of the bone conduction device might develop such a charge. In an exemplary embodiment, a potential difference between the human and the removable component of the bone conduction device when the two are effectively separated from one another such that there is no electrical communication between the two can be on the order of about 1, 2, 3, 4, 5, 6, 7, 8, 9, 10, 11, 12, 13, 14, 15, 17, 19, 22, 25, 30, 35, 40, 45, 50 or about more than 50 thousand volts or any value or range of values therebetween in about 100 volt increments (e.g., about 4,400 volts, about 22,900 volts, about 2,500 to 30,500 volts, etc.). This, coupled with a sufficient buildup in charge in the human recipient and/or the removable component of the bone conduction device 400 can result, in at least some in instances, in the aforementioned deleterious results, at least at the instant when, or more accurately, just before, the removable component of the bone conduction device 400 is coupled to the skin penetrating abutment 620 of the recipient if there exists a low resistance conductive path in the removable component of the bone conduction device leading to, for example, the electromagnetic transducer, that comes into close enough proximity to the skin penetrating abutment. For example, consider the scenario where a metallic component of the removable component extended to within, for example, less than about ½ mm of the abutment screw 674, even with the plastic of the sleeve 444 therebetween, where the metallic component was electrically coupled to the remainder of the transducer in a low resistivity manner (e.g. electrically low resistivity coupled to the bobbin body 454A, etc.). If a sufficiently high potential difference exists between the removable component and the recipient, and at least one of the removable component of the bone conduction device and the human has a high enough charge, static electricity can arc between the abutment 620 and/or the abutment screw 674 and the metallic component (in some instances it can arc through the sleeve 444). The arcing static electricity can be of a magnitude such that one or more the deleterious results detailed herein can result.

In at least some embodiments of the embodiments detailed herein and/or variations thereof having at least some of the geometries detailed herein and/or variations thereof, the aforementioned deleterious results vis-à-vis static electricity are prevented from occurring, or at least the likelihood of such occurrences substantially reduced relative to that of the exemplary bone conduction device having the ½ mm gap between metallic components just detailed in the prior paragraph.

More particularly, in an exemplary embodiment, there is a removable component of the bone conduction device 400, including a connector (e.g., coupling apparatus 444) configured to removable connect the removable component to a metallic skin penetrating component, such as by way of example only and not by way of limitation, the abutment 620, with or without the abutment screw 674. The removable component is configured such that when the connector is operationally connected to the metallic skin penetrating component (and thus brought into electrical communicative proximity of the metallic skin penetrating component (abutment 620 and/or screw 674)) when the connector is grounded and a potential difference between the connector and the skin penetrating component T1 seconds prior to the is connector contacting the skin penetrating component is V volts, this potential difference will be substantially maintained, in the absence of any change in the grounding state of the recipient and/or the skin penetrating component, for at least T2 seconds after the connector is operationally coupled to the skin penetrating component (i.e., the configuration of FIG. 6 is achieved). That is, this potential difference will be substantially maintained from the beginning of T1 to the end of T2.

In various exemplary embodiments, at least about 95%, 90%, 85%, 80%, 75%, 70%, 65%, 60%, 55% or about 50% of the aforementioned potential differences are maintained during the aforementioned temporal periods. In an exemplary embodiment, T1 and/or T2 is about 1 second, about 1 microseconds, or about 1 millisecond. In an exemplary embodiment, T1 and/or T2 is about 100 nanoseconds, 200 ns, 300 ns, 400 ns, 500 ns, 600 ns, 700 ns, 800 ns, 900 ns, 1 μs, 10 μs, 50 μs, 100 μs, 200 μs, 300 μs, 400 μs, 500 μs, 600 μs, 700 μs, 800 μs, 900 μs, 1 ms, 10 ms, 100 milliseconds, 200 ms, 300 ms, 400 ms, 500 ms, 600 ms, 700 ms, 800 ms, 900 ms, 1 second, 2 seconds, three seconds, four seconds, five seconds or more or any value or range of values in between any of these values in 10 nanosecond increments (e.g., about 430 ns, about 10.05 microseconds, about 820 ns to about one-half second, etc.)

In an exemplary embodiment, V is about 0.5 thousand, 0.6, 0.7, 0.8, 0.9, 1, 1.5, 2, 3, 4, 5, 6, 7, 8, 9, 10, 11, 12, 13, 14, 15, 17, 19, 22, 25, 30, 35, 40, 45, 50 thousand or about more than 50 thousand volts or any value or range of values therebetween in about 100 volt increments (e.g., about 4,400 volts, about 10,000 volts, about 22,900 volts, about 2,500 to 30,500 volts, etc.).

More particularly, in an exemplary embodiment, there is a removable component of the bone conduction device 400, including a connector (e.g., coupling apparatus 444) configured to removable connect the removable component to a metallic skin penetrating component, such as by way of example only and not by way of limitation, the abutment 620, with or without the abutment screw 674. The removable component is configured such that when the connector is operationally connected to the metallic skin penetrating component (and thus brought into electrical communicative proximity of the metallic skin penetrating component (abutment 620 and/or screw 674)) when one of the skin penetrating component and the connector is grounded and the other of the skin penetrating component and the connector has a charged capacitance of X picofarads, and a potential difference between the connector and the skin penetrating component is Y volts, a total energy flow to the grounded component is no more than Z millijoules per a given time period T, which configuration can be tested in a laboratory environment.

In an exemplary embodiment, X is about 25, 30, 35, 40, 45, 50, 55, 60, 65, 70, 75, 80, 85, 90, 95, 100, 105, 110, 115, 120, 125, 130, 135, 140, 145, 150, 155, 160, 165, 170, 175, 180, 185, 190, 195, 200, 210, 220, 230, 240, 250, 260, 270, 280, 280, 300, 325, 350, 375, 400, 425, 450, 475, 500, 525, 550, 575, 600 or more picofarads, or any value or range of values therebetween in 1 picofarad increment (e.g., about 111 picofarads, about 1000 picofarads, about 292 picofarads, about 77 to about 424 picofarads, etc.).

In an exemplary embodiment, Y is about 2, 3, 4, 5, 6, 7, 8, 9, 10, 11, 12, 13, 14, 15, 17, 19, 22, 25, 30, 35, 40, 45, 50 or about more than 50 thousand volts or any value or range of values therebetween in about 100 volt increments (e.g., about 4,400 volts, about 10,000 volts, about 22,900 volts, about 2,500 to 30,500 volts, etc.).

In an exemplary embodiment, Z is about 10, 15, 20, 25, 30, 35, 40, 45, 50, 55, 60, 65, 70, 75, 80, 85, 90, 95, 100, 105, 110, 115, 120, 125, 130, 135, 140, 145, 150, 155, 160, 165, 170, 175, 180, 185, 190, 195, 200, 210, 220, 230, 240, 250, 260, 270, 280, 280, 300, 325, 350, 375, 400, 425, 450, 475, 500, 525, 550, 575, 600 or more millijoules, or any value or range of values therebetween in 1 millijoule increments (e.g., about 51 millijoules, about 100 millijoules, about 77 to about 424 millijoules, etc.).

In an exemplary embodiment, T is about 1 second, about 1 microsecond, or about 1 millisecond. In an exemplary embodiment, T is about 0.5, 1, 1.5, 2, 2.5, 3, 3.5, 4, 4.5, 5, 5.5, 6, 6.5, 7, 7.5, 8, 8.5, 9, 9.5, 10 or more orders of magnitude more than the time it would take to transfer any one of the aforementioned values of for Z for anyone of the aforementioned values of Y for any one of the aforementioned values of X. By way of example only and not by way of limitation, for a value of X of 100 picofarads and a value of Y of 10,000 volts, a total energy flow to the grounded component is no more than 50 millijoules per second in some embodiments, no more than 50 millijoules per microsecond in some embodiments and/or no more than 50 millijoules per millisecond in some embodiments. Again, these features can be replicated in a laboratory environment to determine whether a given configuration meets at least one of any single possible permutation detailed above.

In an exemplary embodiment, the aforementioned T1 and/or T2 is about 0.5, 1, 1.5, 2, 2.5, 3, 3.5, 4, 4.5, 5, 5.5, 6, 6.5, 7, 7.5, 8, 8.5, 9, 9.5, 10 or more orders of magnitude more than the time it would take to transfer any one of the aforementioned values of for Z for anyone of the aforementioned values of Y for any one of the aforementioned values of X. By way of example only and not by way of limitation, for a value of X of 100 picofarads and a value of Y of 10,000 volts, a total energy flow to the grounded component is no more than 50 millijoules per second in some embodiments, no more than 50 millijoules per microsecond in some embodiments and/or no more than 50 millijoules per millisecond in some embodiments. Again, these features can be replicated in a laboratory environment to determine whether a given configuration meets at least one of any single possible permutation detailed above.

In at least some embodiments, the bone conduction devices detailed herein and/or variations thereof are configured such that configuration of such an embodiment meets at least one of any single possible permutation detailed above.

All of this said, in an exemplary embodiment, there is a removable component of a bone conduction device configured such that when (i) a 50 percentile male of U.S. citizenship or a European Union passport holder, completely naked, can move a distance of at least one of 5, 10, 15 and/or 20 meters without once separating the bottoms of his feet from a wool carpet having a pile of between 10 and 20 mm and without touching any other object constituting a ground until he has developed a static charge and a potential difference concomitant with such movement relative to the removable component (ii) subsequently picks up the removable component of the bone conduction device from a table having sufficiently high resistivity such that effectively none of the charge and or potential difference is dissipated and then (iii) subsequently couples the removable component of the bone conduction device to a titanium abutment passing through his skin and connected directly to a titanium bone fixture penetrating at least 5 mm into his mastoid bone such a substantial amount of the outer surface thereof is osseointegrated to the mastoid bone, the recipient at least one of perceives no shock associated with static discharge and/or a total energy flow to the removable component is no more than 50 millijoules per microsecond, or millisecond or second or ten seconds.

All of this said, in an exemplary embodiment, there is a removable component of a bone conduction device configured such that when (i) a 20, 30, 40, 50, 60, 70 and/or 80 percentile, or any value or range of values therebetween in 1% increments, male and/or female of U.S. citizenship or a European Union passport holder, completely naked, can move a distance of at least one of 5, 10, 15 and/or 20 meters without once separating the bottoms of his feet from a wool carpet having a pile of between 10 and 20 mm and without touching any other object constituting a ground until he has developed a static charge and a potential difference concomitant with such movement relative to the removable component (ii) subsequently picks up the removable component of the bone conduction device from a table having sufficiently high resistivity such that effectively none of the charge and or potential difference is dissipated and then (iii) subsequently couples the removable component of the bone conduction device to a titanium abutment passing through his skin and connected directly to a titanium bone fixture penetrating at least 5 mm into his mastoid bone such a substantial amount of the outer surface thereof is osseointegrated to the mastoid bone, the recipient at least one of perceives no shock associated with static discharge and/or a total energy flow to the removable component is no more than 50 millijoules per microsecond, or millisecond or second or ten seconds.

In this regard, in an exemplary embodiment, the only component between the metallic fastener and the abutment or abutment screw vis-à-vis the closest distance between the two is the plastic coupling.

It is noted that any method of manufacture described herein constitutes a disclosure of the resulting product, and any description of how a device is made constitutes a disclosure of the corresponding method of manufacture. Also, it is noted that any method detailed herein constitutes a disclosure of a device to practice the method, and any functionality of a device detailed herein constitutes a method of use including that functionality.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A device, comprising:

a transducer; and a connection assembly in fixed relationship with the transducer, configured to transfer vibrational energy directly or indirectly, at least one of to or from, the transducer, wherein the device includes a second component of the connection assembly, a first component of the connection assembly is actively held by positive retention to the device by the second component of the connection assembly, the device is a removable component of a bone conduction device, and the connection assembly is configured to connect to a skin penetrating component, the first component is a snap-coupling apparatus having teeth with spaces therebetween, the spaces opening downward away from the transducer, the teeth snapping into place below a flange of the skin penetrating component during connection to the skin penetrating component, and the first component is held by positive retention to the device by a protective sleeve configured to limit a number of interface regimes of the connection assembly with the skin penetrating component, the protective sleeve being the second component.

2. The device of claim 1, wherein:

the first component of the connection assembly is held by positive retention by the second component to a remainder of the device.

3. The device of claim 1, wherein:

the first component of the connection assembly is a removable component that is held by positive retention by the second component that is also a removable component to a remainder of the device.

4. The device of claim 1, wherein:

the device is a removable component of a percutaneous bone conduction device.

5. The device of claim 1, further comprising:

a passage from a space inside the transducer to the protective sleeve.

6. The device of claim 5, wherein:

a portion of the protective sleeve is located within the passage.

7. The device of claim 6, wherein:

the protective sleeve is screw-fit into the passage.

8. The device of claim 6, wherein:

the protective sleeve is press-fit into the passage, wherein a force of at least 20 Newtons applied to the protective sleeve through the passage is required to remove the protective sleeve from the passage.

9. The device of claim 6, wherein the protective sleeve includes male screw threads that interface with female screw threads on an inside of the passage.

10. The device of claim 6, wherein:

the protective sleeve is at least one of interference-fit or adhesively fit in the passage.

11. The device of claim 1, wherein:

the device is a removable component of a passive transcutaneous bone conduction device.

12. The device of claim 1, further comprising:

a housing enveloping at least a portion of the transducer; and a rotation limiter that limits rotation of the housing relative to the transducer about a longitudinal axis of the transducer.

13. The device of claim 1, wherein:

the device is a removable prosthetic component removable from a recipient, and the device is configured such that the connection assembly removes with removal of the removable component from the recipient.

14. The device of claim 1, wherein:

the device is configured such that the connection assembly moves with movement of the transducer upon removal of device from a recipient.

15. The device of claim 1, wherein:

the connection assembly is configured such that the first component mates with a third component that is part of an implanted connection assembly to removable couple the device to a recipient.

16. The device of claim 1, wherein:

with respect to a plane normal to a longitudinal axis of the device, the plane bisects only the first component and the second component, and wherein the plane bisects a geometric center of the second component.

17. A device, comprising:

a transducer; and a housing encompassing at least a portion of the transducer, wherein the device includes a rotation limiter that limits rotation of the housing relative to the transducer, wherein the rotation limiter comprises one or more components in fixed relationship to the transducer and one or more components in fixed relationship to the housing that are configured to rotationally move relative to one another until contact between the respective components, thereby limiting the rotation, and at least one of:

(A) at least one of (i) the one or more components in fixed relationship to the transducer or (ii) the one or more components in fixed relationship to the housing, are male components; and at least another of (i) the one or more components in fixed relationship to the transducer or (ii) the one or more components in fixed relationship to the housing, are female components in a male-female relationship with the corresponding male component, wherein the female component defines the extent to which relative rotation of the housing occurs as a result of limiting the movement of the male component therein, and with respect to a cross-section of the rotation limiter lying on a plane normal to a longitudinal axis of the device, relative to distance from the longitudinal axis, there is overlap of the one or more components in fixed relationship to the transducer and the other of the one or more components in fixed relationship to the housing so that the one or more components in fixed relationship to the transducer and the one or more components in fixed relationship to the housing will contact each other as a result of rotations about the longitudinal axis of one component relative to the other, thereby halting further rotation in a horizontal direction; or (B) the one or more components in fixed relationship to the housing are monolithic components with at least a substantial portion of the housing.

18. The device of claim 17, wherein:

at least one of (i) the one or more components in fixed relationship to the transducer or (ii) the one or more components in fixed relationship to the housing, are male components; and at least an other of (i) the one or more components in fixed relationship to the transducer or (ii) the one or more components in fixed relationship to the housing, are female components in a male-female relationship with the corresponding male component, wherein the female component defines the extent to which relative rotation of the housing occurs as a result of limiting the movement of the male component therein, and with respect to a cross-section of the rotation limiter lying on a plane normal to a longitudinal axis of the device, relative to distance from the longitudinal axis, there is overlap of the one or more components in fixed relationship to the transducer and the other of the one or more components in fixed relationship to the housing.

19. The device of claim 18, wherein:

with respect to the plane of rotation to which an axis of rotation due to the relative rotation is normal, a cross-section of the device lying on the plane includes the female component and the male component in male-female relationship with each other, and the outline of the cross-section has a male-female relationship.

20. The device of claim 17, wherein the one or more components in fixed relationship to the housing are monolithic components with at least a substantial portion of the housing.

21. The device of claim 17, wherein:

the rotation limiter limits relative rotation of the housing and the transducer about the longitudinal axis of the transducer, wherein the longitudinal axis of the transducer extends from the transducer to a coupling of the device, the coupling being located outside the housing.

22. The device of claim 17, wherein:

at least one of (i) the one or more components in fixed relationship to the transducer or (ii) the one or more components in fixed relationship to the housing, are male components; and at least another of (i) the one or more components in fixed relationship to the transducer or (ii) the one or more components in fixed relationship to the housing, are female components in a male-female relationship with the corresponding male component, wherein the female component defines the extent to which relative rotation of the housing occurs as a result of limiting the movement of the male component therein, with respect to a cross-section of the rotation limiter lying on a plane normal to a longitudinal axis of the device, relative to distance from the longitudinal axis, there is overlap of the one or more components in fixed relationship to the transducer and the other of the one or more components in fixed relationship to the housing, and the female components and the male components have cross-sections located on a plane normal to the axis of rotation of the housing relative to the transducer, wherein the axis of rotation of the housing relative to the transducer extends from the transducer to a coupling of the device outside the housing, wherein the cross-sections have respective female cross-sections and male cross sections that interact with each other in a male-female relationship.

23. The device of claim 17, wherein:

at least one of (i) the one or more components in fixed relationship to the transducer or (ii) the one or more components in fixed relationship to the housing, are male components; and at least another of (i) the one or more components in fixed relationship to the transducer or (ii) the one or more components in fixed relationship to the housing, are female components in a male-female relationship with the corresponding male component, wherein with respect to a cross-section of the rotation limiter lying on a plane normal to a longitudinal axis of the device, relative to distance from the longitudinal axis, there is overlap of the one or more components in fixed relationship to the transducer and the other of the one or more components in fixed relationship to the housing, and rotational movement is enabled until the male components strike the female components and/or vis-a-versa, thus limiting the rotation, and the striking occurs on surfaces that are at least more aligned with a longitudinal axis of the device than an axis that is normal to the longitudinal axis of the device.

24. A device, comprising:

a removable component of a bone conduction device, including:

a connector apparatus configured to removably connect the removable component to a recipient skin penetrating component, wherein the removable component of the bone conduction device does not include any metallic components within at least about 3 mm from a longitudinal end of the removable component on the connector side thereof, thereby providing improved resistance to electrostatic discharge at least with respect to such that can damage components of the bone conduction device and/or cause a sensation of pain or otherwise discomfort in the recipient during coupling of the removable component of the bone conduction device to a metallic skin penetrating component.

25. The device of claim 24, wherein:

the removable component includes a transducer; and the transducer is in fixed relationship with the connector apparatus via an extension component comprising substantial amounts of metal by volume, that extends from the transducer to the connector.

26. The device of claim 25, wherein:

the connector is directly connected to the extension component; and the extension component is the closest metallic component to the longitudinal end of the removable component on the connector side thereof.

27. The device of claim 25, wherein:

the connector includes a protective sleeve fixed to the removable component of the bone conduction device, the removable protective sleeve being configured to limit a number of interface regimes of the connector with the skin penetrating component; and the protective sleeve includes a female portion opening towards the longitudinal end of the bone conduction device configured to receive a male portion of the skin penetrating component of the recipient, wherein the protective sleeve is received in the extension component.

28. A bone conduction device, comprising:

the device of claim 24; and the recipient skin penetrating component, wherein the skin penetrating component includes an abutment having a female portion in which is received the connector and an abutment screw configured to secure the abutment to the recipient, a head of the abutment screw being located in the female portion, and the head of the abutment screw is no closer than about 1.5 mm from any metal component of the removable component.

29. The device of claim 24, wherein:

the removable component includes a transducer;

the connector includes a snap-coupling apparatus having teeth with spaces therebetween, the spaces opening downward away from the transducer, the teeth snapping into place below a flange of the skin penetrating component during connection to the recipient skin penetrating component.

30. The device of claim 24, wherein:

the removable component includes a transducer;

the connector includes a snap-coupling apparatus having teeth with spaces therebetween, the spaces opening downward away from the transducer, the teeth snapping into place below an inner flange of the skin penetrating component during connection to the recipient skin penetrating component; and the connector also includes a protective sleeve configured to limit a number of interface regimes of the connector with the skin penetrating component.

31. A device, comprising:

a transducer; and a housing encompassing at least a portion of the transducer, wherein the device includes a rotation limiter that limits rotation of the housing relative to the transducer about a longitudinal axis of the transducer, the rotation limiter comprises one or more components in fixed relationship to the transducer and one or more components in fixed relationship to the housing that are configured to rotationally move relative to one another, and with respect to a cross-section of the rotation limiter lying on a plane normal to a longitudinal axis of the device, relative to distance from the longitudinal axis, there is overlap between the one or more components in fixed relationship to the transducer and the one or more components in fixed relationship to the housing so that the one or more components in fixed relationship to the transducer and the one or more components in fixed relationship to the housing will contact each other as a result of rotations about the longitudinal axis of one component relative to the other, thereby halting further rotation in a horizontal direction.

32. The device of claim 31, wherein:

the rotation limiter is configured to limit rotation of the housing relative to the transducer about the longitudinal axis of the transducer while the housing is connected to the transducer relative to that which would be the case in the absence of the rotation limiter while the housing is connected to the transducer.

33. The device of claim 31, further comprising:

the rotation limiter comprises one or more components in fixed relationship to the transducer and one or more components in fixed relationship to the housing that are configured to rotationally move about the longitudinal axis of the transducer relative to one another until contact between the respective components, thereby limiting the rotation.

34. The device of claim 33, further comprising:

an apparatus extending from the transducer and extending away from the housing, configured to transfer vibrational energy directly or indirectly, at least one of to or from, the transducer, wherein:

the one or more components in fixed relationship to the transducer are in fixed relationship to the apparatus extending from the transducer.

35. The device of claim 33, wherein the one or more components in fixed relationship to the housing are monolithic components with at least a substantial portion of the housing.

36. The device of claim 31, wherein:

the transducer is connected to the housing by a spring;

the spring permits the housing to move relative to the transducer up and down in the direction of the longitudinal axis; and the device is configured such that the spring is what limits the maximum amount that the housing can move relative to the transducer in the up and down direction along the longitudinal axis.

37. The device of claim 31, wherein:

the transducer is connected to the housing by a spring;

the spring permits the housing to move relative to the transducer up and down in the direction of the longitudinal axis; and the rotation limiter protects the spring from plastic deformation with respect to movement of the housing relative to the transducer due to rotation of the housing relative to the transducer about the longitudinal axis.

* * * * *